US006236394B1

(12) United States Patent
Ikeda

(10) Patent No.: US 6,236,394 B1
(45) Date of Patent: May 22, 2001

(54) POWER SUPPLY CIRCUIT, DISPLAY DEVICE, AND ELECTRONIC INSTRUMENT

(75) Inventor: Masuhide Ikeda, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/194,444

(22) PCT Filed: Mar. 27, 1998

(86) PCT No.: PCT/JP98/01394

§ 371 Date: May 11, 1999

§ 102(e) Date: May 11, 1999

(87) PCT Pub. No.: WO98/44621

PCT Pub. Date: Oct. 8, 1998

(30) Foreign Application Priority Data

Mar. 28, 1997 (JP) ..... 9-094893

(51) Int. Cl.[7] ..... G09G 5/00
(52) U.S. Cl. ..... 345/211; 345/95
(58) Field of Search ..... 345/211, 204, 345/210, 87, 95; 323/225, 297; 349/33

(56) References Cited

U.S. PATENT DOCUMENTS

| | | | | |
|---|---|---|---|---|
| 5,198,767 | * | 3/1993 | Haight | 345/95 |
| 5,343,217 | * | 8/1994 | Kim | 345/95 |
| 5,402,142 | * | 3/1995 | Okada et al. | 345/95 |
| 5,404,150 | * | 4/1995 | Murata | 345/95 |
| 5,510,814 | * | 4/1996 | Ise | 345/211 |
| 5,859,632 | * | 3/1996 | Ito | 345/211 |

FOREIGN PATENT DOCUMENTS

| | | |
|---|---|---|
| 2 271 458 | 4/1994 | (GB) . |
| 57-142128 | 9/1982 | (JP) . |
| 5-111241 | 4/1993 | (JP) . |
| 6-130910 | 5/1994 | (JP) . |

OTHER PUBLICATIONS

Alt, Paul M. et al., "Scanning Limitations of Liquid–Crystal Displays," IEEE Transactions on Electron Devices, vol. 21, No. 2, 1974, pp. 146–155.

* cited by examiner

*Primary Examiner*—Amare Mengistu
(74) *Attorney, Agent, or Firm*—Oliff & Berridge, PLC

(57) ABSTRACT

An object is to provide a power supply circuit, display device and electronic instrument which can reduce the power consumption in the power supply circuit itself and which can set a boosting ratio according to the duty ratio. The power supply circuit comprises: a charge pump circuit including a first switching unit (40) for charging a capacitor CP and a second switching unit (42) for transferring the charge in the capacitor CP to another capacitor CB; and a circuit for generating switching signals for controlling the first and second switching units. The first switching unit (40) includes switching elements SW11A and SW11B each of which is connected at one end to a different potential VDD or VE1, the other end thereof being connected to one end of the capacitor CP. The switching signal generation circuit controls ON and OFF-states of the switching element SW11A while turning the other switching element SW11B off, or controls ON and OFF-states of the switching element SW11B while turning the other switching element SW11A off. Thus, the boosting ratio can variably be controlled. The potential of the switching signal in the OFF state is equalized with a potential supplied to the source of a switching transistor. At a partial display on a liquid crystal display device, the boosting ratio is controlled according to the duty ratio.

18 Claims, 41 Drawing Sheets

| DUTY RATIO | OPTIMUM BOOSTING RATIO RBO | BOOSTING RATIO RB |
|---|---|---|
| 1 / N | $\sqrt{N}$ / L | |
| 1 /120 | 2.74 | TRIPLEX BOOSTING |
| 1 /160 | 3.16 | QUADPLEX BOOSTING |
| 1 / 200 | 3.54 | QUADPLEX BOOSTING |
| 1 / 240 | 3.87 | QUADPLEX BOOSTING |
| 1 / 320 | 4.47 | QUINTUPLEX BOOSTING |
| 1 / 480 | 5.48 | SEXTUPLEX BOOSTING |

X7 TIMING B

X7 TIMING A

X6 TIMING B

X6 TIMING A

X5 TIMING B

X5 TIMING A

X4 TIMING B

X4 TIMING A

X3 TIMING B

X3 TIMING A

| FIG. 18A |
| --- |
| FIG. 18B |

| FIG. 33A |
| --- |
| FIG. 33B |

POWER SUPPLY CIRCUIT, DISPLAY DEVICE, AND ELECTRONIC INSTRUMENT

TECHNICAL FIELD

The present invention relates to a power supply circuit, display device and electronic instrument.

BACKGROUND OF ART

In recent years, it has strongly been desired in the field of portable electronic instruments such as portable telephone, and pager to prolong display time without exchange of battery in addition to reduction of size and weight. It is thus severely required that a display device build in a portable electronic instrument less consumes the power.

The inventor had widely studied liquid crystal display devices which are of one of various display types, in view of reduction of power consumption.

As a result, it has been found that the conventional liquid crystal display devices had their power supply circuit for supplying a power voltage, which itself consumed very large amount of power. The power supply circuit required about ⅓ of the power to be consumed in the liquid crystal display device.

To overcome such a problem as described, an object of the present invention is to reduce the power consumption of the power supply circuit itself and thus the power consumption in display devices and electronic instruments that use such a power supply circuit.

DISCLOSURE OF THE INVENTION

To this end, the present invention provides a power supply circuit for converting a voltage and for supplying the converted voltage as a power supply voltage, the power supply circuit comprising:

at least one charge pump circuit which includes a first capacitor, a second capacitor, a first switching means for charging the first capacitor based on a given voltage, and a second switching means for transferring the charge in the first capacitor to the second capacitor; and a switching signal generation circuit for generating a plurality of switching signals which control the first and second switching means;

wherein the first switching means includes a plurality of switching elements, one ends of the switching elements being electrically connected to different potentials, and the other ends thereof being electrically connected to at least one end of the first capacitor; and wherein the switching signal generation circuit receives at least one given first control signal for controlling at least one of the boosting (step-up) ratio and the deboosting (step-down) ratio, and then generates the switching signals for controlling ON and OFF-states of one of the switching elements specified by the first control signal, and for turning off at least one other switching element.

According to this aspect of the present invention, for example, the first switching means may comprise first, second and third switching elements respectively connected at one end to first, second and third potentials. If the first control signal is used to set a first boosting (or deboosting) ratio, the first switching element is ON-OFF controlled while the second and third switching elements are turned OFF. Thus, the first capacitor will be charged based on the first potential. On the other hand, if the first control signal is used to set a second boosting ratio, the second switching element is ON-OFF controlled while the first and third switching elements are turned OFF. Thus, the first capacitor will be charged based on a second potential. As a result, there can be provided a converted voltage different from that obtained by using the first potential. Similarly, if the first control signal is used to set a third boosting ratio, the first capacitor will be charged based on a third potential to provide a converted voltage different from those obtained by using the first and second potentials. According to the present invention, thus, the boosting of deboosting ratio can variably be controlled by the first control signal. Furthermore, there is an advantage that the boosting and deboosting ratio can variably be controlled while effectively preventing the output impedance of the power supply circuit from being increased associated with the addition of any new switching element or the overall circuit from being increased in scale.

The plurality of switching elements may be connected to at least one end of the first capacitor. Further, a structure that the opposite ends of the first capacitor are connected to a plurality of switching elements is also within the scope of the present invention.

The switching signal generation circuit may comprises: a circuit for generating a basic switching signal; a decoder for decoding the first control signal; and an output circuit for receiving the output of the decoder and the basic switching signal to output a switching signal generated based on the basic switching signal toward one of the switching elements to be ON-OFF controlled and to output a switching signal fixed at a given potential toward at least one other switching element not to be ON-OFF controlled. In this way, a switching signal for controlling ON and OFF of one switching element and for tuning off the other switching elements can simply be generated. In addition, various types of switching signals can be generated merely by changing the wiring or other section of the decoder.

The output circuit may include a level shifter for converting the amplitude of the basic switching signal on the basis of a reference potential as well as a charge pump potential from the charge pump circuit. Thus, the system can generate a switching signal that has an amplitude required to ON-OFF control the switching elements.

The switching signal generation circuit may receive a reference potential and a charge pump potential of the charge pump circuit for setting the potentials of switching signals during the OFF-state period outputted toward switching transistors included in the first and second switching means at one of the reference potential and the charge pump potential both of which are supplied to the source of the switching transistors. In this way, the switching transistor can properly be turned off during the OFF-state period of the switching signal to prevent the power from being consumed unnecessarily.

The present invention further provides a display device comprising: the aforementioned power supply circuit; a drive circuit for outputting scan and data signals based on the power supply voltage form the power supply circuit; and a panel having scan lines into which the scan signals are inputted, data lines into which the data signals are inputted, and a display element driven by the scan and data lines; wherein at least one of the boosting and deboosting ratios is varied by varying the first control signal according to the duty ratio in the panel. The unnecessary power consumption can effectively be reduced since the boosting and deboosting ratios can be controlled according to the duty ratio.

In the display device of the present invention, a given second signal may be used to select K scan lines among N scan lines and to unselect (N-K) scan lines for performing a partial display; and at the partial display, the first control signal may be varied depending on the number of selected scan lines to vary at least one of the boosting and deboosting ratios. In this way, the partial display can be made to divide a screen into a display area and a non-display area while effectively preventing any unnecessary power consumption.

The present invention further provides an electronic instrument comprising the aforementioned display device and a central control means for processing for setting the first and second control signals. For example, the first and second control signals can be set through a software on the central control means such as CPU and MPU in the electronic instrument.

The present invention further provides a power supply circuit for converting a voltage and for supplying the converted voltage as a power supply voltage, the power supply circuit comprising:

at least one charge pump circuit which includes a first capacitor, a second capacitor, a first switching means for charging the first capacitor based on a given voltage, and a second switching means for transferring the charge in the first capacitor to the second capacitor; and a switching signal generation circuit for generating a plurality of switching signals which control the first and second switching means;

wherein the switching signal generation circuit receives a reference potential and a charge pump potential of the charge pump circuit for setting the potentials of switching signals during the OFF-state period outputted toward switching transistors included in the first and second switching means at one of the reference potential and the charge pump potential both of which are supplied to the source of the switching transistors.

The potential of the switching signal inputted into the switching transistor during the OFF-state period can be equal to the reference potential of the charge pump potential supplied to the source of that switching transistor. Thus, the switching transistor can properly be turned off. Since the amplitude of the switching signal can be reduced, any unnecessary power consumption can effectively be prevented.

The switching signal generation circuit may set the potentials of the switching signals during the OFF-state period based on a plurality of charge pump potentials from a plurality of charge pump circuits. Thus, when a final converted voltage is obtained by the plural charge pump circuits, the potentials generated by these charge pump circuits can effectively be utilized.

The switching signal generation circuit may comprise: a circuit for generating a basic switching signal; and a level shifter for converting the amplitude of the basic switching signal based on the reference and charge pump potentials. When such a level shifter is used, a switching signal which is used to ON-OFF control the switching transistor and to equalize the potential of the switching signal during the OFF-state period with the source supply potential can simply be generated.

The present invention further provides a display device comprising: the aforementioned power supply circuit; a drive circuit for outputting scan and data signals based on the power supply voltage from the power supply circuit; and a panel having scan lines into which the scan signals are inputted, data lines into which the data signals are inputted, and display elements driven by the scan and data lines. The display device can extremely be reduced in power consumption.

The present invention further provides an electronic instrument comprising the aforementioned display device, and a central control means for processing for controlling the display device. Thus, any electronic instrument such as portable telephone, printer, personal computer, pager, and projector can be reduced in power consumption and improved in battery service life.

BEST MODE FOR CARRYING OUT THE INVENTION

Embodiments of the present invention will now be described with reference to the drawings.

First Embodiment

1. Operations of the First Embodiment

The operations of this embodiment will first be described. A power supply circuit according to the present embodiment converts the voltage through a charge pump system which will be described below.

Figure 1A:
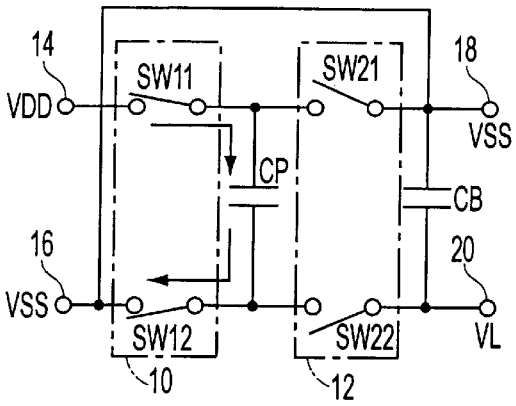
FIGS. 1A and 1B illustrate a charge pump system.
Figure 1B:
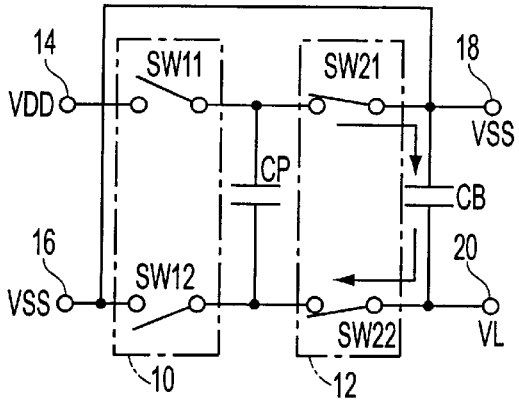

As shown in FIG. 1A, the charge pump system causes a first switching unit 10 (or first switching means) including switching elements SW11 and SW12 to charge a capacitor CP (or first capacitor) based on VDD and VSS which are provided to terminals 14 and 16, during the charging period. During the pump period, a second switching unit 12 (or second switching means( including switching elements SW21 and SW22 is caused to transfer the charge within the capacitor CP to another capacitor CB (or second capacitor), as shown in FIG. 1B. Since the terminal 16 is connected to the other terminal 18 in FIGS. 1A and 1B, the potential of VL=VSS−VDD will eventually be outputted toward a terminal 20 to perform negative single boosting (or reverse boosting). The boosting ratio will be defined relative to VSS as a reference voltage. For example, if VDD is used as a reference voltage, FIGS. 1A and 1B may provide negative double boosting.)

However, this charge pump system raises a problem in that it is difficult to variable control the boosting ratio RB (=(VSS−VL)/(VDD−VSS)).

Figure 1C:
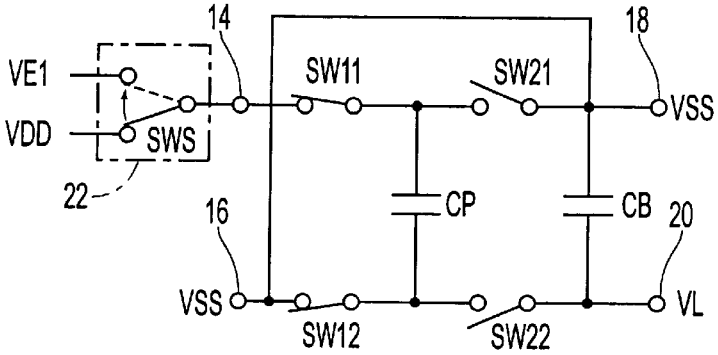
FIGS. 1C and 1D illustrate various manners of varying the boosting ratio.

For example, the first technique of variable controlling the boosting ratio RB may be such a technique as shown in FIG. 1C. According to this technique, a potential switching unit 22 having a switching element SWS is so provided that the boosting ratio RB can variably be controlled by using the switching element SWS to switch the potential supplied to a terminal 14 from VDD to VE1 or vice versa.

In this technique, however, two switching elements SWS and SW11 are interposed between the potential VDD or VE1 and the capacitor CP. Therefore, if the switching elements SWS and SW11 are in the form of a switching transistor, the capacitor CP will less be charged due to the ON-resistance of these switching transistors. This leads to increase of the output impedance in the power supply circuit. As the output impedance increases, the voltage drop due to the load current increases to degrade the display characteristics of the liquid crystal display device using such a power supply circuit. On the contrary, if the transistor size of the switching elements SW11 and SWS is increased to avoid any increase of the output impedance, the chip area of IF formed on the power supply circuit will also be increased. Particularly, many switching transistors have used, for example, a huge size of channel length L=4 $\mu$m×channel width W=about several tens mm to decrease the ON-resistance as small as possible. The area occupied by the switching transistors is the major part of the chip area. Therefore, the chip area is extremely highly influenced by the increase of the switching transistor size. Consequently, the aforementioned prior art shown in FIG. 1C in which the switching elements SWS and SW11 are connected in series to each other is not practical.

Figure 1D:
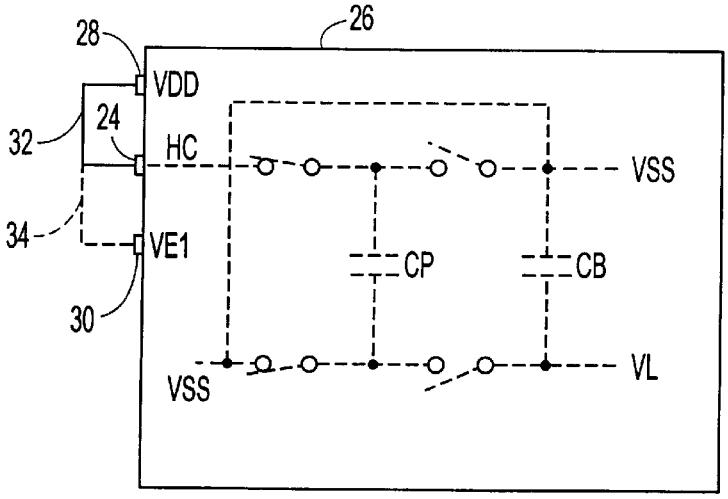

The second technique of variably controlling the boosting ratio RB may be one shown in FIG. 1D. Such a technique variably controls the boosting ratio RB by changing the layout of external leads 32 and 34 outside of IC 26 in the power supply circuit to switch the connection of a terminal 24 from 28 to 30 or vice versa.

However, the just-mentioned technique requires the modification of the external leads 32 and 34 for variably controlling the boosting ratio RB. Therefore, the boosting ratio RB cannot be controlled through a software operating on CPU (or MPU).

The present invention provides such a technique as will be described below.

As shown in FIGS. 2A, 2B, 2C and 2D, a first switching unit 40 comprises a plurality of switching elements SW11A and SW11B, each of which is connected at one end to a different potential VDD or VE1 with the other end being connected to one end of the capacitor CP. The second switching unit 42 is of the same structure as in FIGS. 1A and 1B. A single circle used herein indicates the fact that any switching element encircled by such a single circle is under ON-OFF control. A double circle shows the fact that any switching element encircled by such a double circle is always in its OFF state.

Figure 2A:
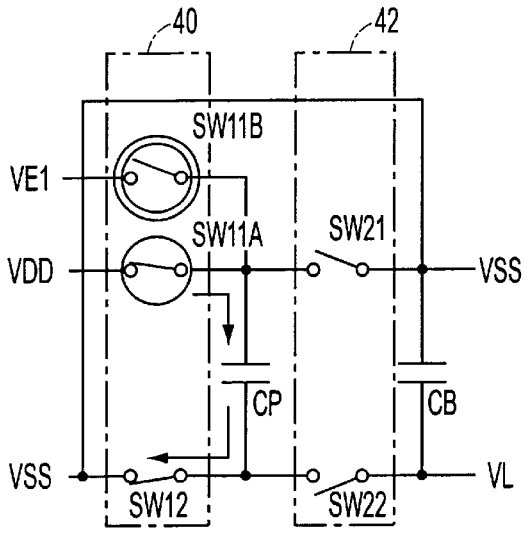
FIGS. 2A, 2B, 2C and 2D illustrate the operations of the first embodiment.
Figure 2B:
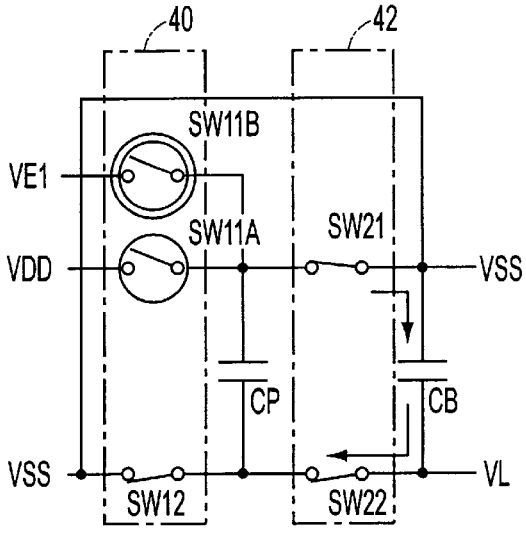
Figure 2C:
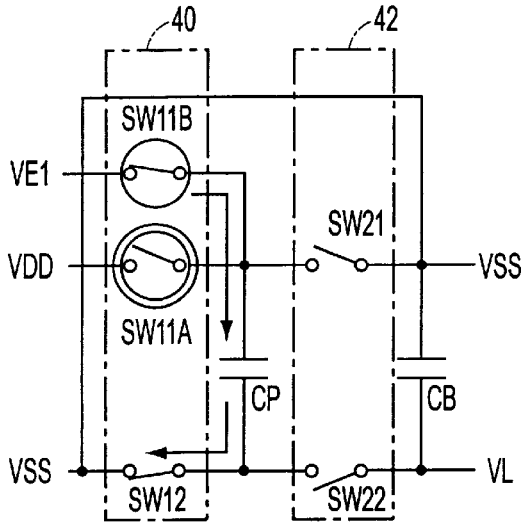
Figure 2D:
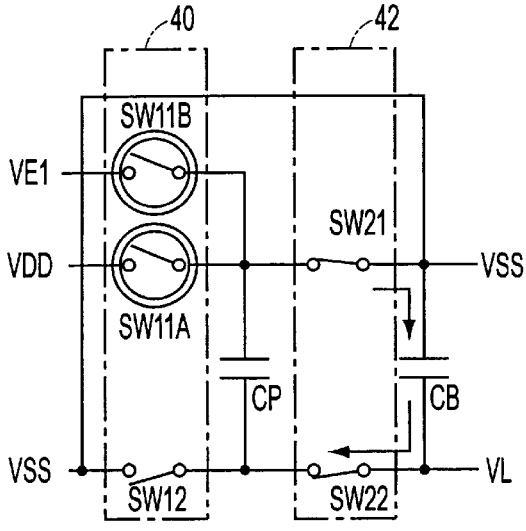

As will be apparent from FIGS. 2A–2D, this embodiment is characterized by that the boosting ratio RB can variably be controlled by switching the switching element placed under ON-OFF control to the always OFF switching element or vice versa. More particularly, FIGS. 2A and 2B show the ON-OFF controlled switching element SW11A encircled by a single circle and the always OFF switching element SW11B encircled by a double circle while FIGS. 2C and 2D show the ON-OFF controlled switching element SW11B encircled by a single circle and the always OFF switching element SW11A encircled by a double circle. In FIGS. 2A and 2B, thus, the capacitor CP is charged by VDD and VSS while in FIGS. 2C and 2D, the capacitor CP is charged by VE1 and VSS. Therefore, the voltage VL in FIGS. 2A and 2B becomes VSS−VDD while the voltage VL in FIGS. 2C and 2D becomes VSS−VE1. This means that these voltages are placed in different levels or that the boosting ratio RB is variably controlled.

Which of the switching elements SW11A and SW11B is to be ON-OFF controlled is determined based on a given boosting control signal (or first control signal). For example, if the boosting control signal sets the operation for boosting the voltage VL to VSS–VDD, the switching element SW11A will be ON-OFF controlled. On the other hand, if the boosting control signal sets the operation for boosting the voltage VL to VSS–VE1, the switching element SW11B will be ON-OFF controlled. The generation of the switching signal for performing the aforementioned switching control is accomplished by a switching signal generation circuit which will be described later.

As described, in FIG. 1C, there is raised a problem in that two switching elements SWS and SW11 are interposed between the potential VDD or VE1 and the capacitor CP. On the contrary, this embodiment only includes a single switching element SW11A or SW11B between the potential VDD or VE1 and the capacitor CP. Therefore, this embodiment can effectively avoid various problems associated with the increased output impedance due to the parasitic resistance in the switching element, degradation of the display characteristics and others.

In FIG. 1D, additionally, there is raised a problem in that the boosting ratio RB cannot variably be controlled through a software operating on CPU. To overcome such a problem, this embodiment can cause a software operating on CPU to variably control the boosting ratio RB by controlling the digital boosting control signal. Thus, the software can perform the control of power supply voltage in a partial display as will be described, for example.

Figure 3A:
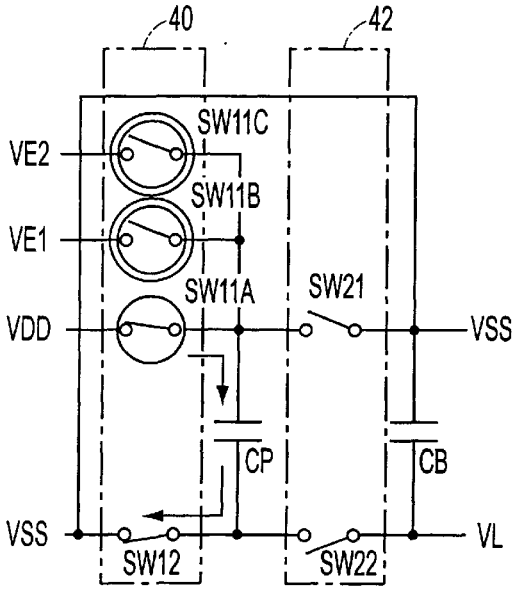
FIGS. 3A, 3B, 3C and 3D also illustrate the operations of the first embodiment.
Figure 3B:
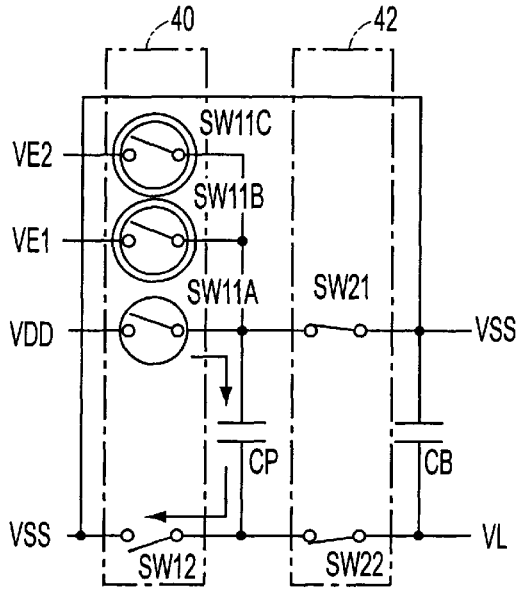

Although FIGS 2A–2D illustrate two switching elements SW11A and SW11B connected to one end of the capacitor CP, the present invention may be applied to any other form in which three switching elements SW11A, SW11B and SW11C are connected to the capacitor CP as shown in FIGS. 3A and 3B or that four or more switching elements are similarly connected to the capacitor CP.

Figure 3C:
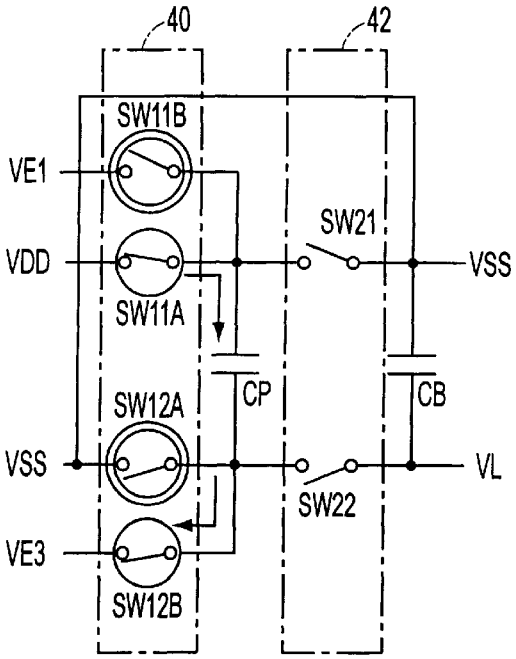
Figure 3D:
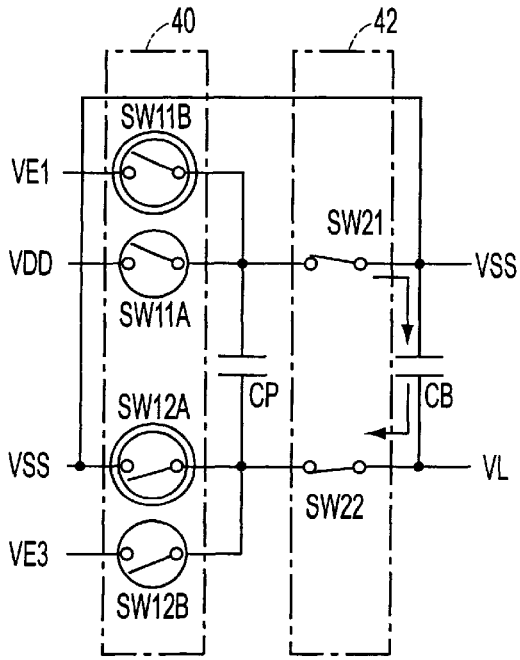

A plurality of switching elements may be connected to each end of the capacitor CP as shown in FIGS. 3C and 3D.

Although FIGS. 2A–2D and 3A–3D have been described as to negative boosting, this embodiment may be applied to positive boosting (step-up operation) or deboosting (step-down operation). With deboosting, the first control signal becomes a deboosting control signal.

2. Liquid Crystal Display Device

Figure 4:
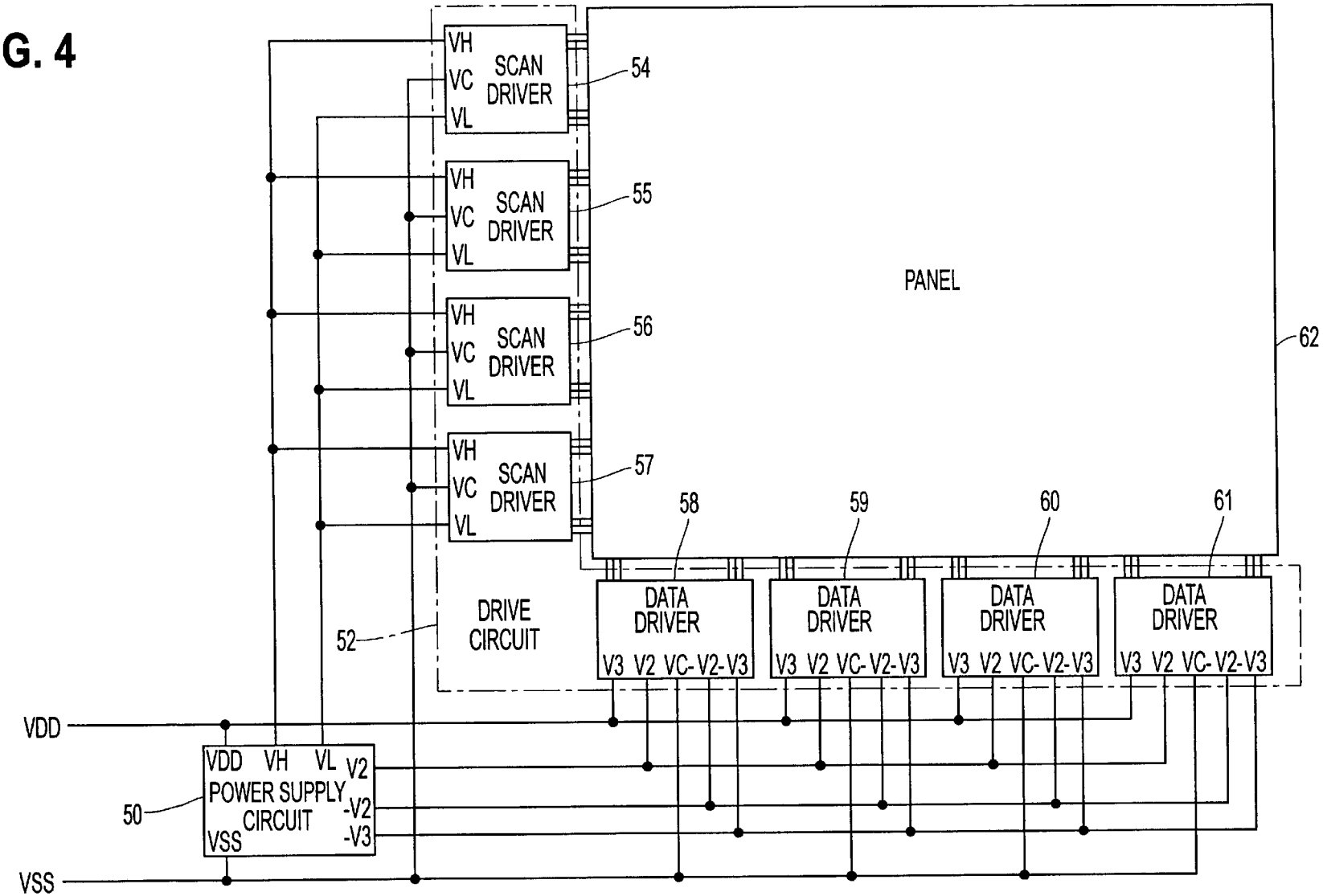
FIG. 4 is a view showing a structure of the liquid crystal display device.

A liquid crystal display device including the power supply circuit of the present embodiment will now be described. Referring to FIG. 4, there is shown the overall structure of a liquid crystal display device which includes a power supply circuit 50 of this embodiment. Power supply voltage from the power supply circuit 50 is supplied to a drive circuit 52 including scan drivers 54–57 and data drivers 58–61. The drive circuit 52 generates scan and data signals based on the power supply voltage and outputs generated signals to a panel 62. The panel 62 has scan lines into which the scan signal is inputted, data lines into which the data signal is inputted and liquid crystal elements driven through these scan and signal lines.

In the liquid crystal display device of FIG. 4, liquid crystal is actuated through a multi-line drive method (or MLS drive method, described in Japanese Patent Application No. Hei 4-84007, Japanese Patent Application Laid-Open No. Hei 5-46127 or Japanese Patent Application Laid-Open No. Hei 6-130910). In the MLS drive method, a plurality of scan lines are simultaneously selected to reduce the drive voltage for the overall scan lines. The power supply circuit 50 supplies, to the scan drivers 54–57, potentials VH (high positive potential) and VL (high negative potential) for generating the drive voltage for the scan lines. To form these potentials VH and VL from the potentials VDD and VSS, such a technique as described in connection with FIGS. 2A–3D performs the conversion of voltage.

Figures 5A, 5B:
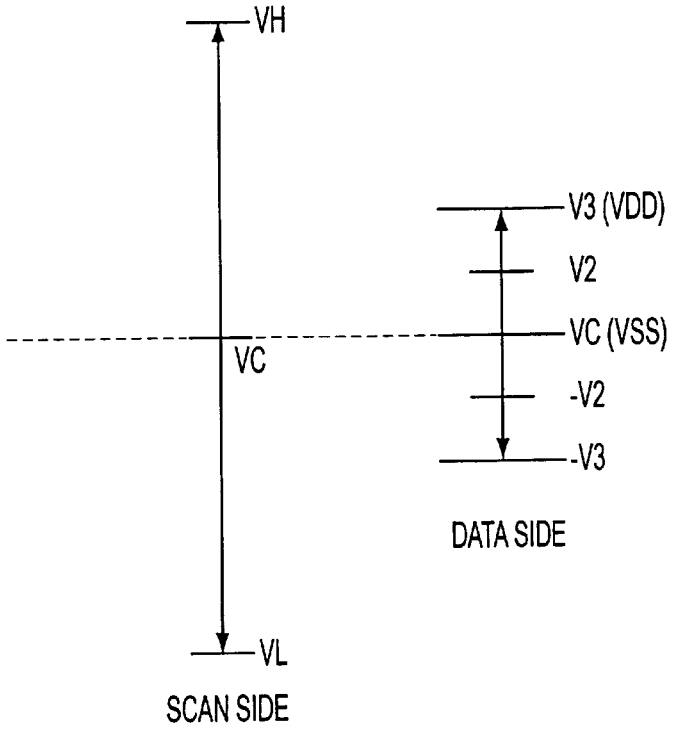
FIGS. 5A and 5B illustrate the relationship between the duty ratio and the boosting ratio.

FIG. 5A shows the relationship between the duty ratio (or ratio of scan signal selection period to a frame period) in the MLS drive method in which four lines are simultaneously selected and the optimum boosting ratio RBO, and FIG. 5B shows the relationship of potentials. As the duty ratio, 1/N, is determined, the optimum boosting ratio RBO for providing the optimum contrast is determined. This relationship can be represented by RBO=(VH–VC)/(V3–VC)=(VH–VC)/(VDD–VSS)=(VC–VL)/(VDD–VSS). Therefore, if the duty ratio is 1/120, the optimum boosting ratio RBO is 2.74. It is thus desirable that the boosting ratio RB of the power supply circuit is triplicated. Similarly, with the duty ratios of 1/160, 1/200, 1/240, 1/320 and 1/480, it is desirable that the boosting ratio is respectively quadruplicated, quadruplicated, quadruplicated, quintuplicated and sextuplicated.

If the boosting ratio is not changed with change of the duty ratio, when the liquid crystal display device is driven with the duty ratio of 1/120 through a power supply circuit that can perform sextuplex boosting for the duty ratio of 1/480, for example, the liquid crystal display device will be driven with sextuplex boosting rather than its sufficient triplex boosting. Thus, the power supply circuit itself will unnecessarily consume the power, so that the power consumption in the liquid crystal display device and electronic instrument increases, leading to reduction of the battery life or other problems.

On the other hand, if such a technique as described in connection with FIGS. 1C and 1D is used to vary the boosting ratio RB in association with change of the duty ratio, it raises various other problems such as degraded display characteristics, and increased chip area.

To avoid such problems, this embodiment variably controls the boosting ratio RB while minimizing the degradation of display characteristics and the increase of chip area. Therefore, the boosting ratio RB can be controlled into a proper value corresponding to a duty ratio in connection with change of that duty ratio.

Figure 6:
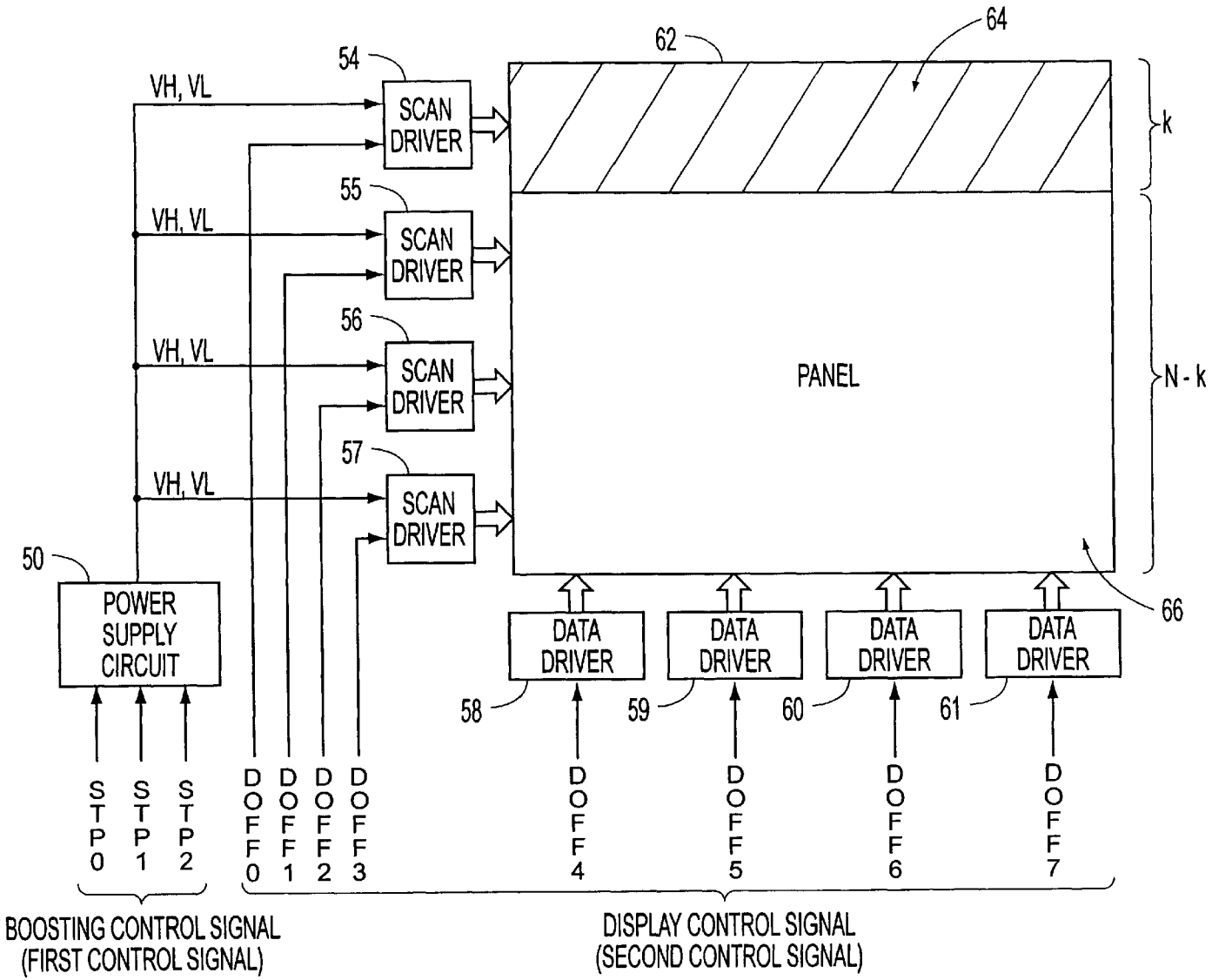
FIG. 6 illustrates the partial display.

The power supply circuit of this embodiment is particularly useful for a partial display wherein K scan lines among N scan lines are selected while the other (N-K) scan lines are not selected, as shown in FIG. 6. In FIG. 6, a display control signal (or second control signal) DOFF0 is inactive while other display control signals DOFF1–DOFF3 are active. Thus, the scan driver 54 outputs the normal scan signal while the outputs of the scan drivers 55–57 are fixed, for example, at VC (see FIG. 5B). As a result, the partial display can be made such that the screen on the panel 62 can be divided into an area 64 used to display a picture and another area 66 not used to display a picture.

With such a partial display, the duty ratio changes from 1/N to 1/K. As will be apparent from FIG. 5A, it is thus desirable that the boosting ratio RB is also changed. In this embodiment, therefore, the boosting control signals (or first control signal) STP0–STP2 are varied to change the levels of VH and VL. Thus, the power supply circuit 50 can supply the optimum VH and VL corresponding to the duty ratio (or partial display area) to the scan drivers 54–57. This can highly reduce any unnecessary power consumption on the partial display. This embodiment is particularly advantageous in that almost all the controls required by the partial display can be accomplished through a software as operates on CPU since such a software can digitally control both the boosting control signals STP0–STP2 and display control signals DOFF0–DOFF7.

As DOFF4, DOFF5, DOFF6 or DOFF7 becomes active, the output of the data driver 58, 59, 60 or 61 is fixed, for example, at VC. Thus, the partial display can be performed with a boundary in the direction of data lines.

Figure 7A:
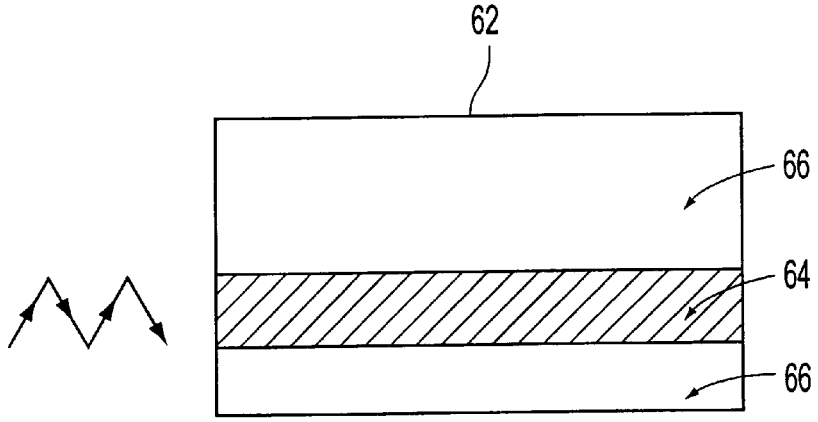
FIGS. 7A, 7B and 7C also illustrate the partial display.
Figure 7B:
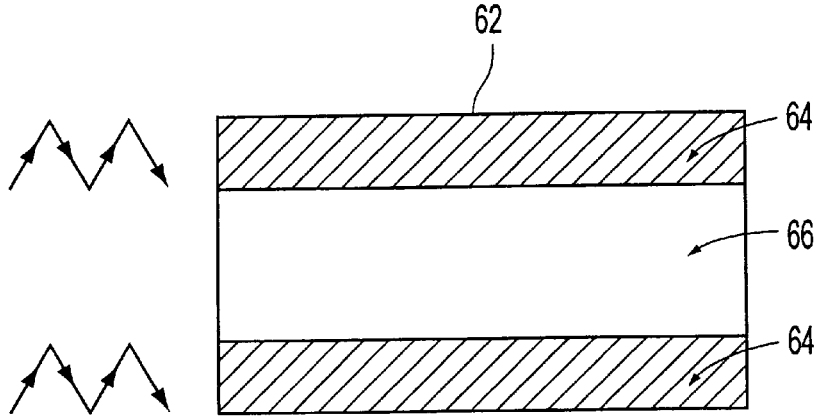
Figure 7C:
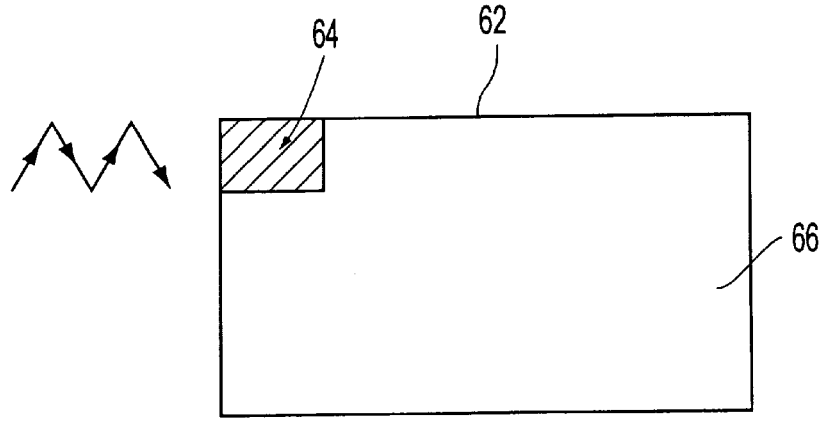

Examples of the partial display may take any of various forms as shown in FIGS. 7A, 7B and 7C. In FIG. 7A, the area 64 used to display a picture is set in the middle of the panel 62. In FIG. 7B, the area 64 for display is divided into two. In FIG. 7C, the partial display has the boundaries in both the directions of scan and data lines by controlling the display control signals DOFF4–DOFF7 on the side of data driver in addition to those on the scan driver side.

3. Details of Power Supply Circuit

Figure 8:
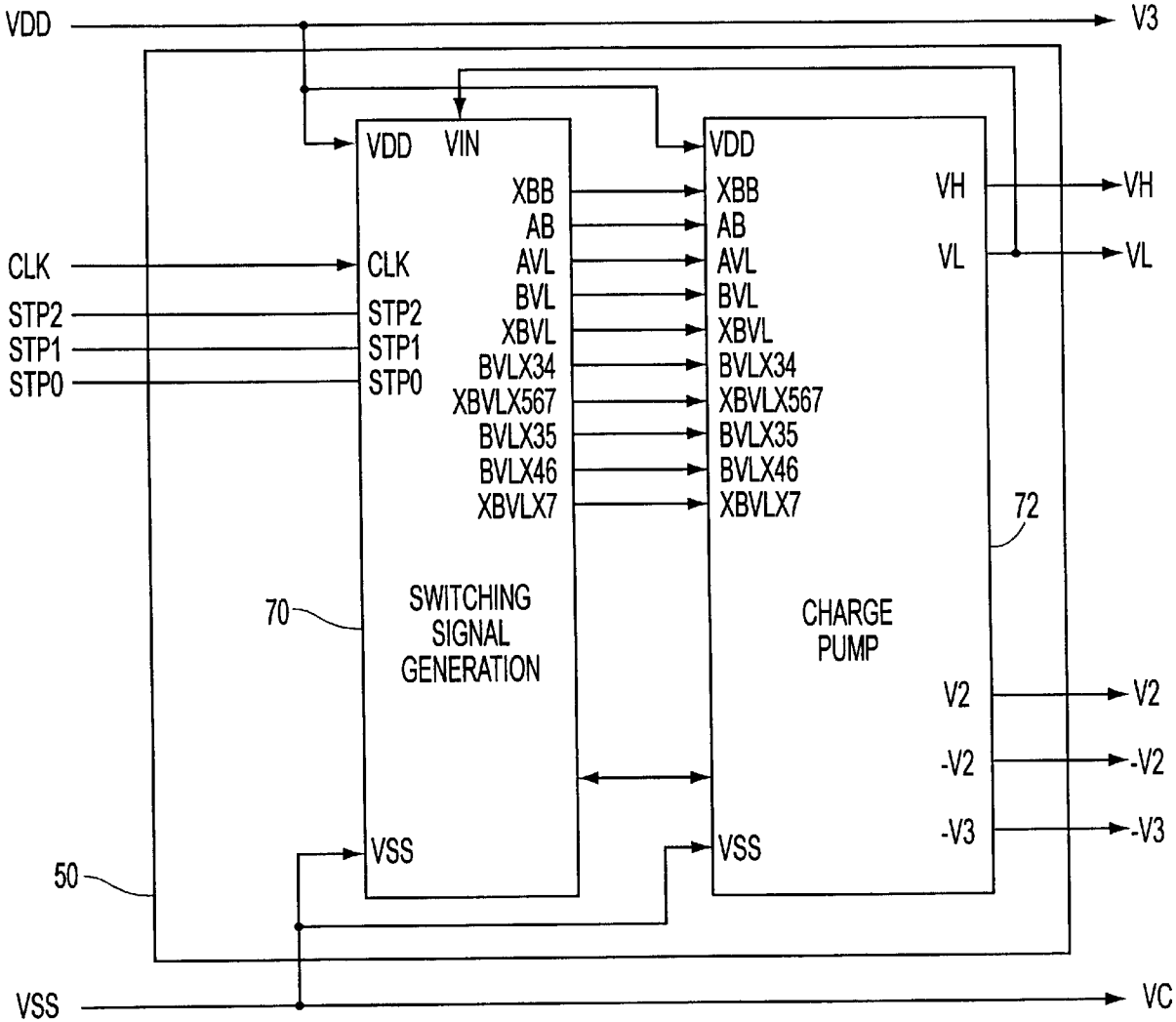
FIG. 8 is a block diagram of the overall structure of the first embodiment.

The power supply circuit will now be described in detail. As shown in FIG. 8, the power supply circuit 50 of this embodiment comprises a switching signal generation circuit 70 and a charge pump unit 72.

The switching signal generation circuit 70 generates various switching signals, XBB, AB, AVL, BVL, XBVL, BVLX34, XBVL567, BVLX35, BVLX46 and XBVLX7 based on input potentials VDD, VSS, clock signal CLK, boosting control signals STP0–STP2 and VL form the charge pump unit 72, and outputs these signals toward the charge pump unit 72. In this case, these switching signals are generated according to the operation described in connection with FIGS. 2A–3D.

The charge pump unit 72 comprises a plurality of charge pump circuits and receives switching signals from the switching signal generation circuit 70 to generate VH, VL V2, −V2 and −V3 which are in turn outputted toward the scan and data drivers. According to this embodiment, the boosting ratio will be varied based on the boosting control signals STP0–STP2 to change the levels of VH and VL.

The boosting by this embodiment will now be described. FIGS. 9A, 9B, 10A, 10B and 10C show the operations of the respective one of septuplex boosting (X7), sextuplex boosting (X6), quintuplex boosting (X5), quadplex boosting (X4) and triplex boosting (X3). In this embodiment, the boosting ratio can be controlled within a range from septuplex to triplex boosting by controlling STP0–STP2.

Septuplex boosting (X7) of FIG. 9A will be described. A capacitor CP2 is coupled with VDD, VSS at timing B (during the charge period) and with VSS, VE2 at timing A (during the pump period). Thus, the potential VE2 is generated based on VSS by the negative single boosting. Based on VDD, the potential VE2 is generated by the negative double boosting. A capacitor CP4 is coupled with VDD, VE23 at timing B, and with VE2, VE4 at timing A. Thus, the potential VE4 is generated by the negative triplex boosting. A capacitor CPVL is coupled with VDD, VE4 at timing B, and with VE4, VL at timing A. Thus, the potential VL is generated by the negative septuplex boosting. A capacitor CPVH is coupled with VH, VSS at timing B, and with VSS, VL at timing A. Thus, the potential VH is generated by the positive septuplex boosting. Capacitors CB2, CB4, CBVL and CBVH are respectively adapted to hold the voltages corresponding to CP2, CP4, CPVL and CPVH.

Figure 9A:
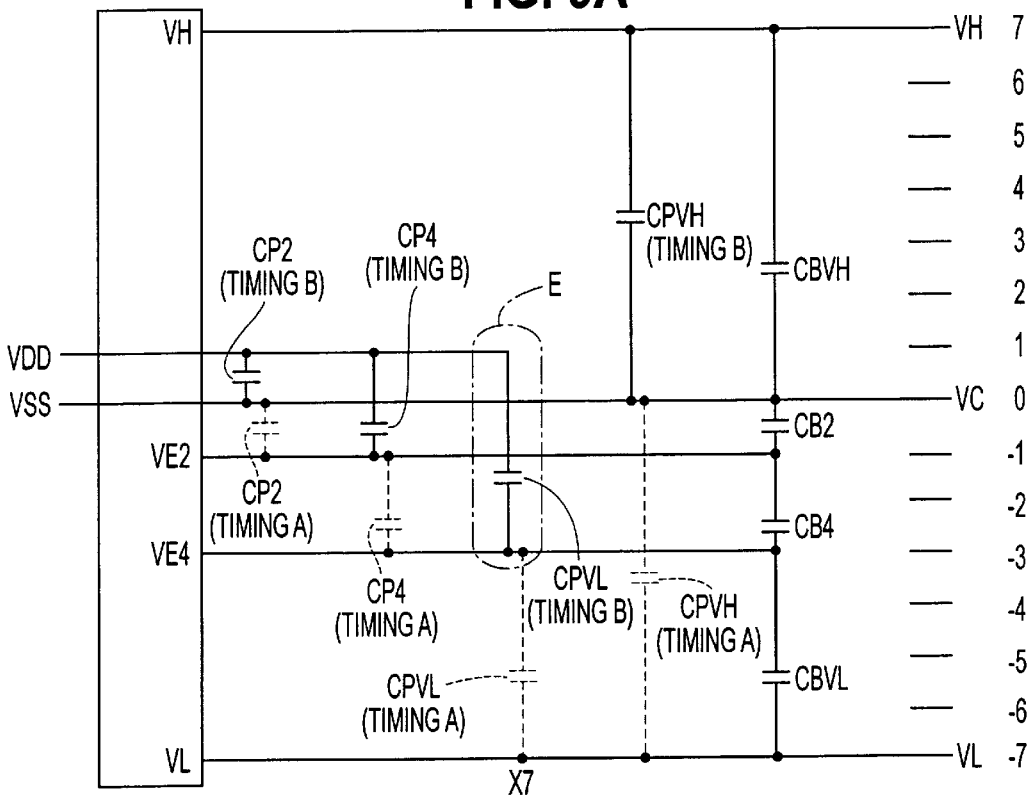
FIGS. 9A and 9B illustrate the principle of boosting the voltage seven and six times.
Figure 9B:
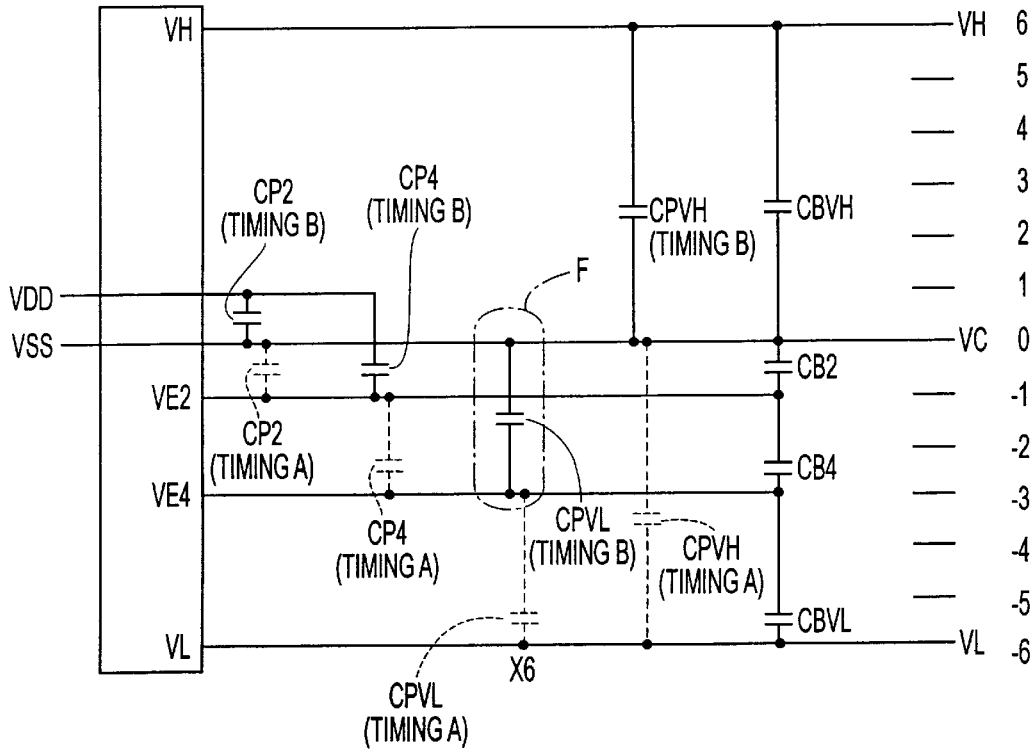

FIG. 9 shows sextuplex boosting (X6) where the potential coupled with CPVL is different form that of FIG. 9A. More particularly, at timing B, CPVL in FIG. 9A is coupled with VDD, VE4 as shown by E, while CPVL in FIG. 9B is coupled with VSS, VE4 as shown by F. Since VSS is lower than VCC by VDD−VSS, septuplex boosting in FIG. 9A varies to sextuplex boosting in FIG. 9B due to a factor of VDD−VSS. The change of the potential coupled with one end of the capacitor CPVL from VDD to VSS is accomplished by such a technique as described in connection with FIGS. 2A–3D.

Figure 10A:
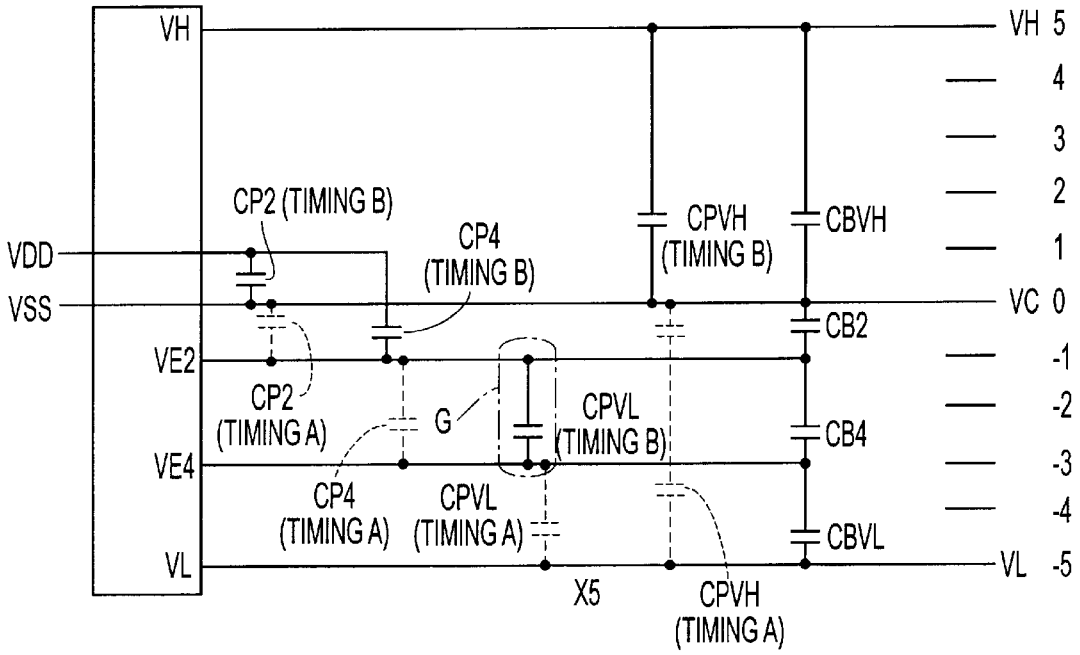
FIGS. 10A, 10B and 10C illustrate the principle of boosting the voltage five, four and three times.
Figure 10B:
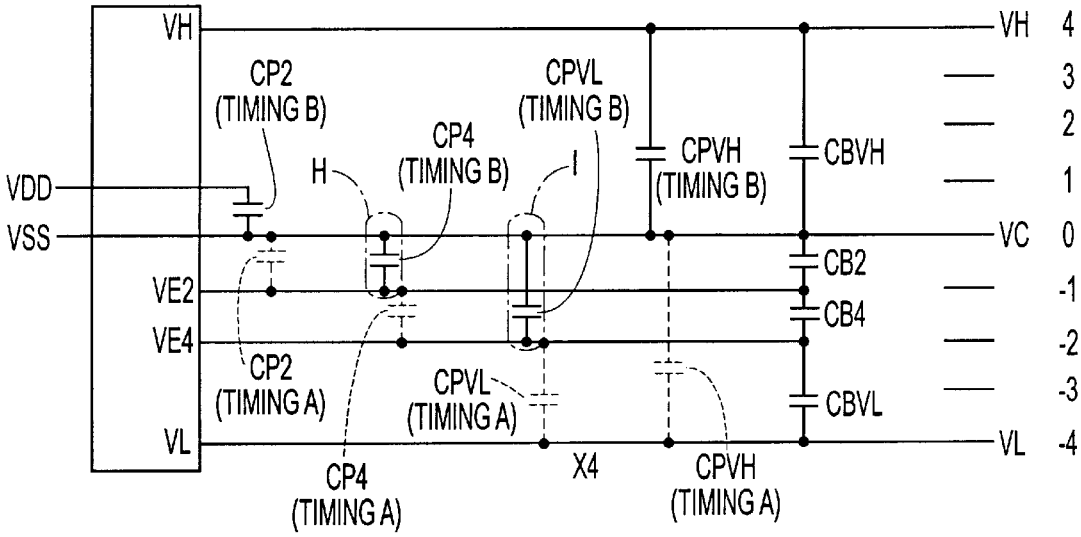
Figure 10C:
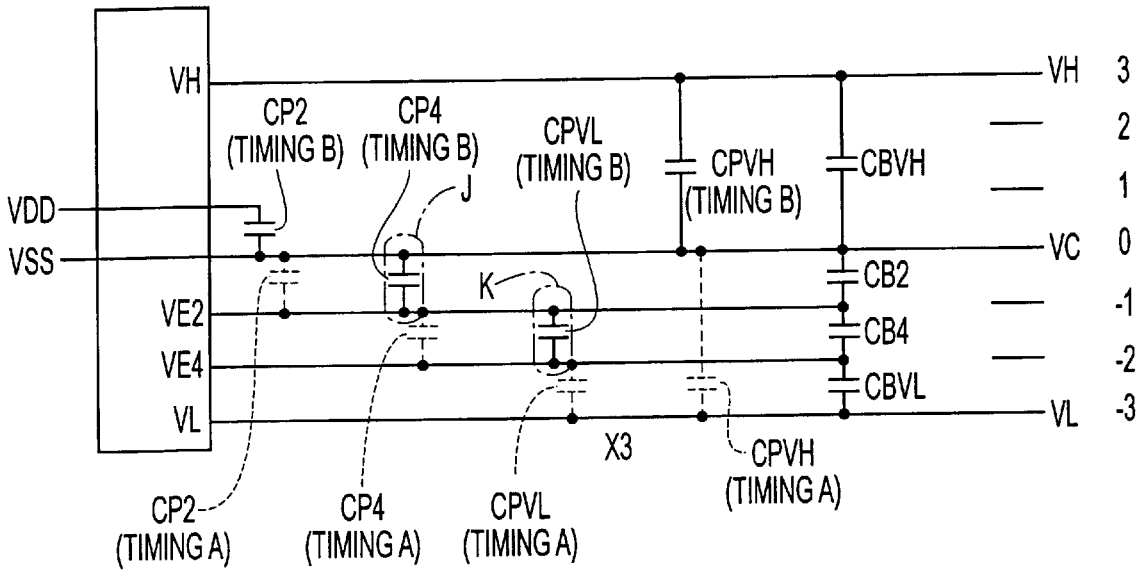

FIG. 10A shows quintuplex boosting (X5) wherein unlike E in FIG. 9A, the capacitor CPVL is coupled with VE2, VE4 at timing B as shown by G. Thus, the boosting ratio can further be lowered. FIG. 10B shows quadplex boosting (X4) wherein the capacitors CP4 and CPVL are repetitively coupled, at timing B, between VSS and VE2 and between VSS and VE4 as shown by H and I. Furthermore, FIG. 10C shows triplex boosting (X3) wherein at timing B, the capacitors CP4 and CPVL are respectively coupled between VSS and VE2 and between VE2 and VE4 as shown by J and K.

This embodiment can variably control the boosting ratio of the power supply circuit within the range between septuplex and triplex boostings through the operation of boosting as described.

The switching elements of this embodiment will further be described in detail with reference to FIGS. 11A–15B.

Figure 11A:
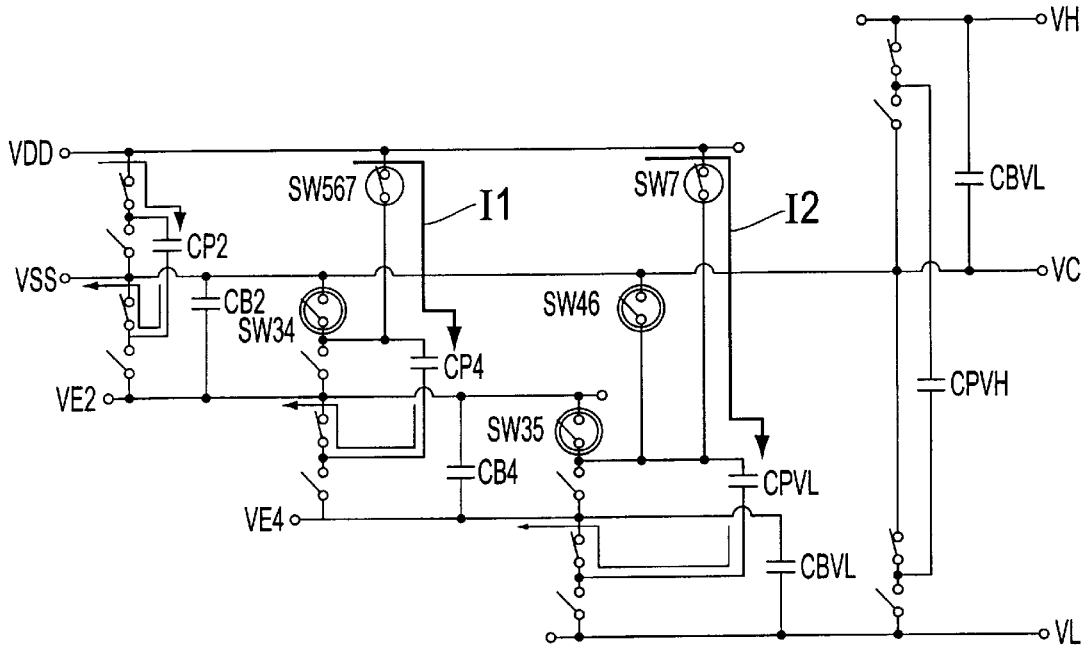
FIGS. 11A and 11B illustrate the detailed operation of the switching element on septuplex boosting.
Figure 11B:
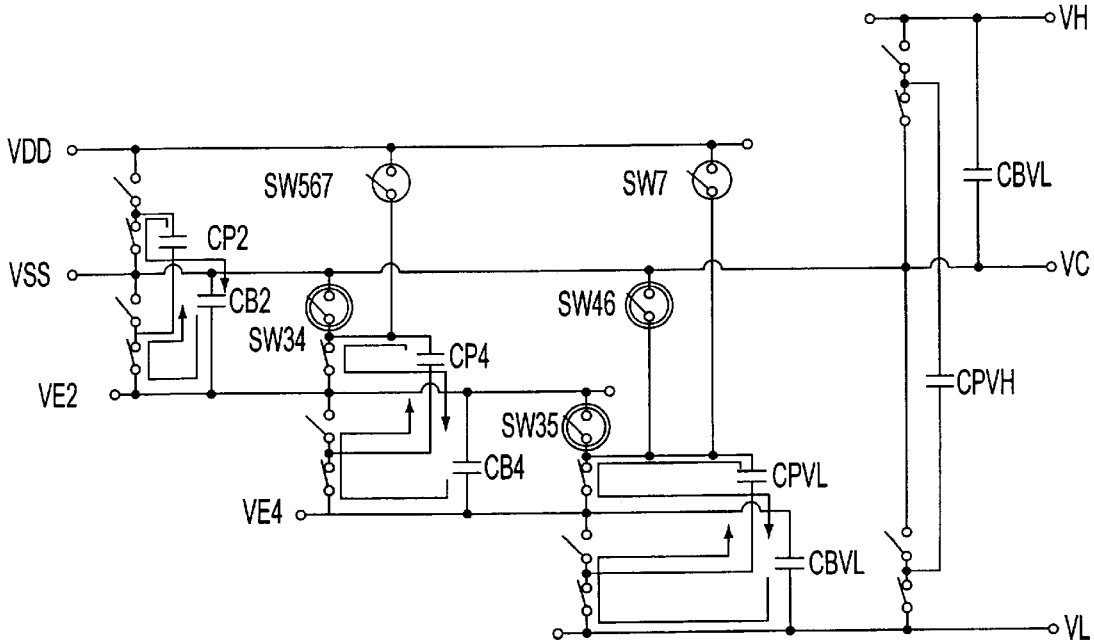

FIGS. 11A and 11B illustrate the operation of the switching elements on the septuplex boosting (X7). Like in FIGS. 2A–3D, a single circle encircles a switching element to be ON-OFF controlled while a double circle encircles a switching element to be always in their OFF state. In FIGS. 11A and 11B, switching elements SW567 and SW7 are ON-OFF controlled while the other switching elements SW34, SW35 and SW46 are always in their OFF state. Thus, the capacitor CP4 will be charged with VDD through a path I1 at timing B. On the other hand, the capacitor CPVL will be charged with VDD through a path I2. More particularly, as described in connection with FIG. 9A, at timing B, the capacitor CP4 will be charged with VDD and VE2 and the capacitor CPVL will be charged with VDD and VE4.

The numeral string "567" in the term of the switching element SW567 indicates that this switching element is ON-OFF controlled on the quintuplex, sextuplex and septuplex boostings and turned OFF on the other boostings. Thus, the switching element SW34 is ON-OFF controlled on the triplex and quadplex boostings; SW7 is ON-OFF controlled on the septuplex boosting; SW46 is ON-OFF controlled on the quadplex and sextuplex boostings; and SW35 is ON-OFF controlled on the triplex and quintuplex boostings. As will be apparent, all the switching elements are turned OFF on the other boostings.

Figure 12A:
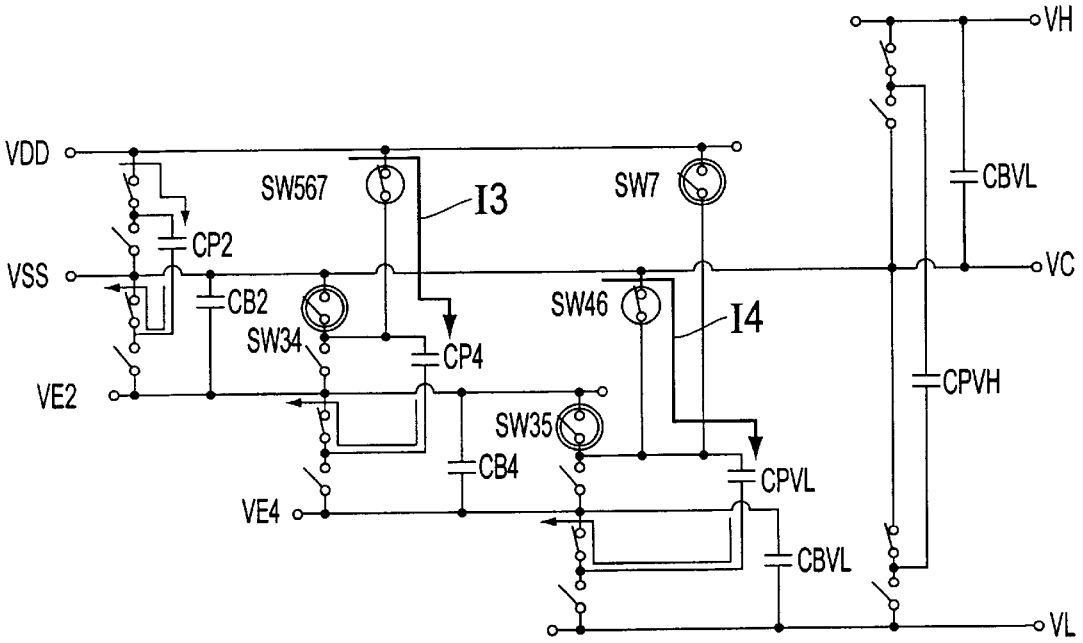
FIGS. 12A and 12B illustrate the detailed operation of the switching element on sextuplex boosting.
Figure 12B:
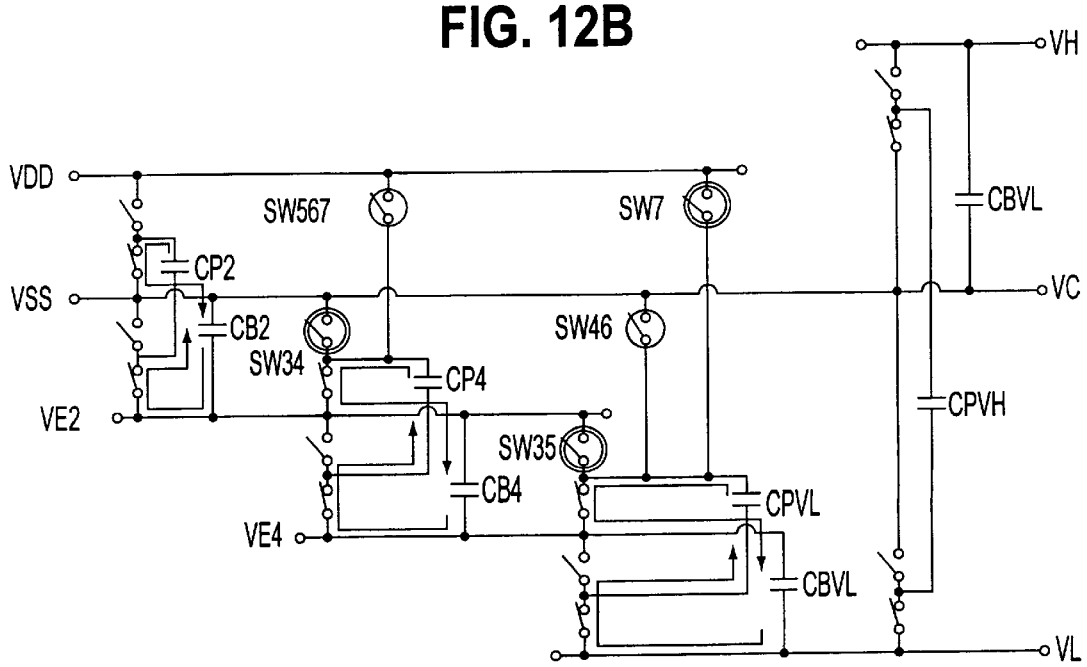

In the sextuplex boosting (X6), the switching elements SW567 and SW46 are ON-OFF controlled while the switching elements SW34, SW7 and SW35 are always in the OFF state, as shown in FIGS. 12A and 12B. The capacitors CP4 and CPVL will thus be charged respectively with VDD and VSS through paths I3 and I4. Unlike the case of FIGS. 11A and 11B, the path to the capacitor CPVL is changed from I2 to I4.

Figure 13A:
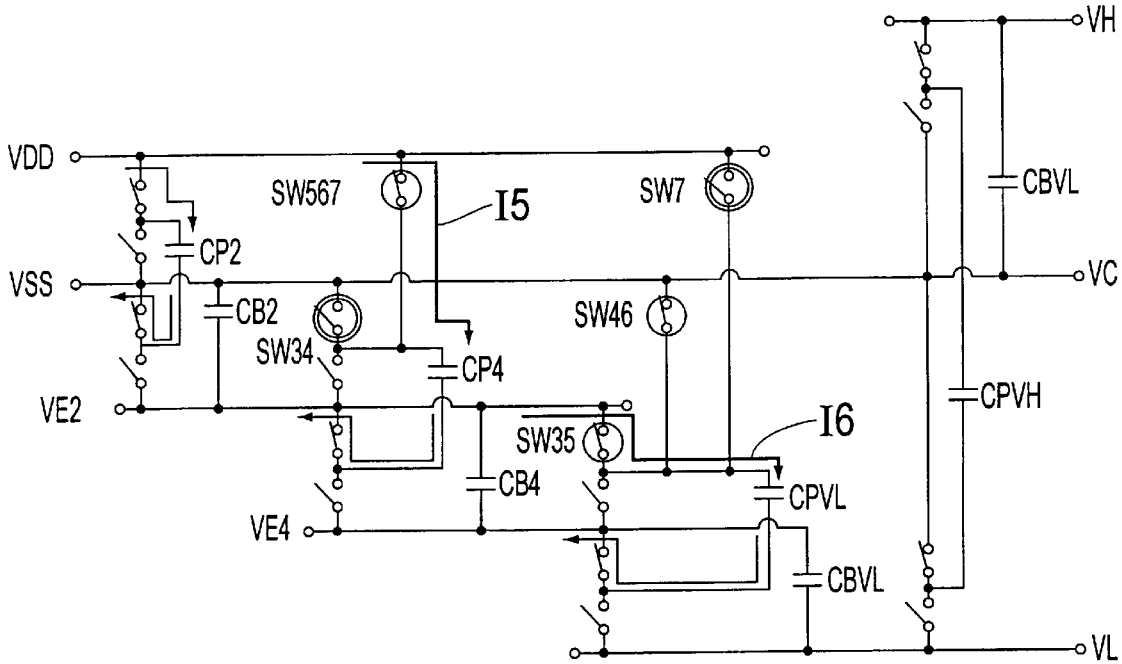
FIGS. 13A and 13B illustrate the detailed operation of the switching element on quintuple boosting.
Figure 13B:
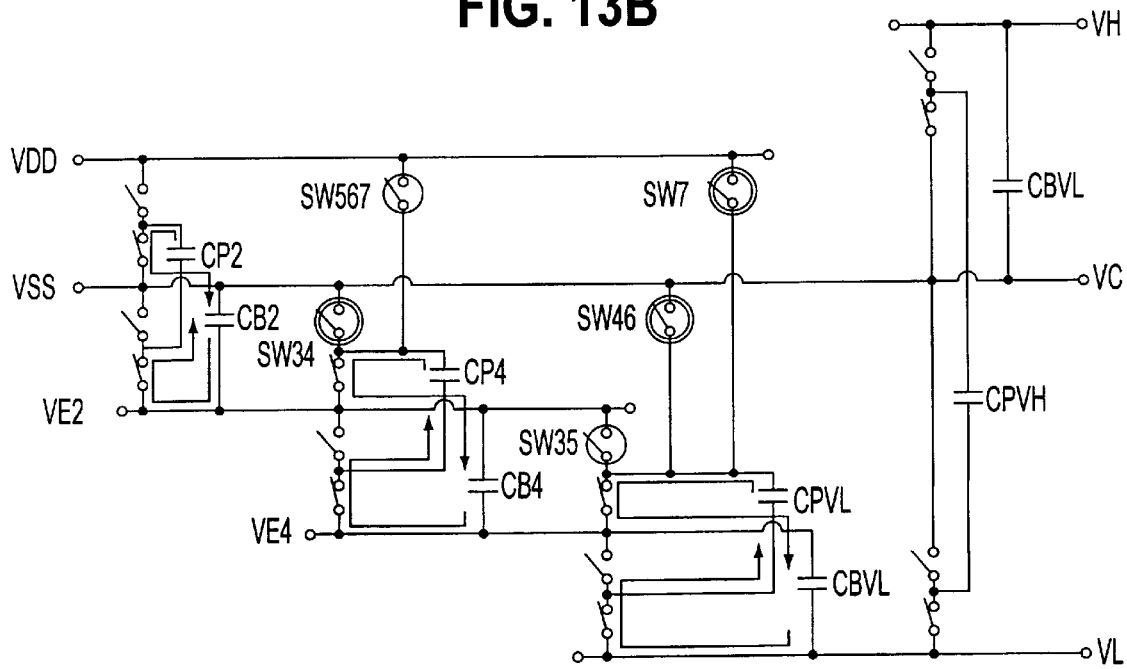

In the quintuplex boosting (X5), the switching elements SW567 and SW35 are ON-OFF controlled while the switching elements SW34, SW7 and SW46 are always in the OFF state, as shown in FIGS. 13A and 13B. The capacitors CP4 and CPVL will thus be charged respectively with VDD and VE2 through paths I5 and I6. Unlike the case of FIGS. 11A and 11B, the path to the capacitor CPVL is changed from I2 to I6.

Figure 14A:
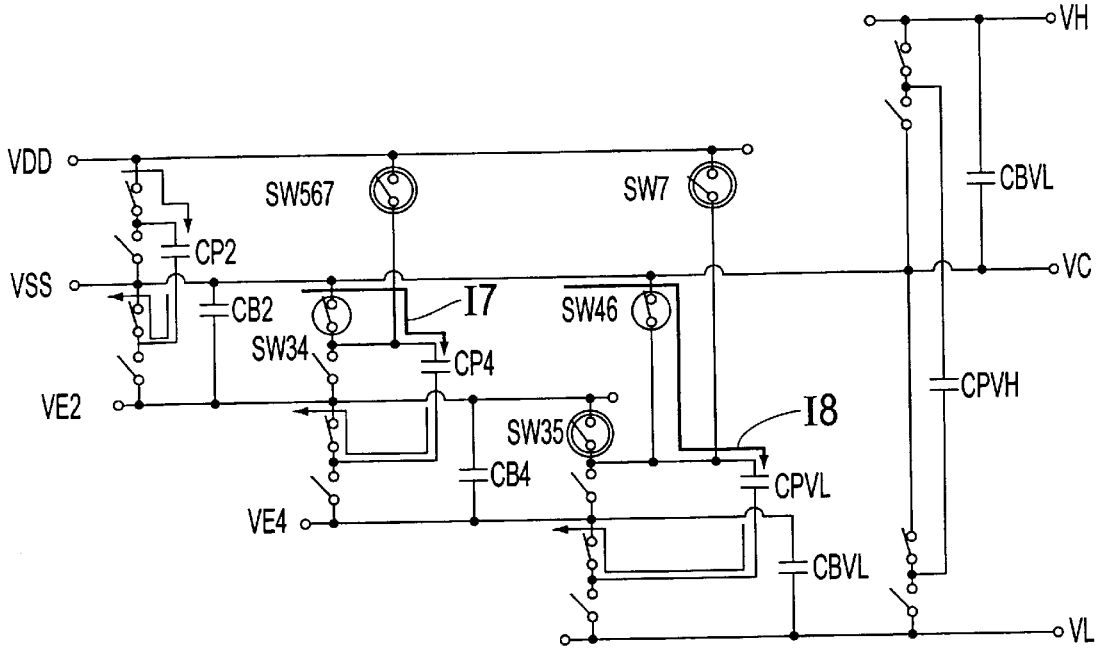
FIGS. 14A and 14B illustrate the detailed operation of the switching element on quadplex boosting.
Figure 14B:
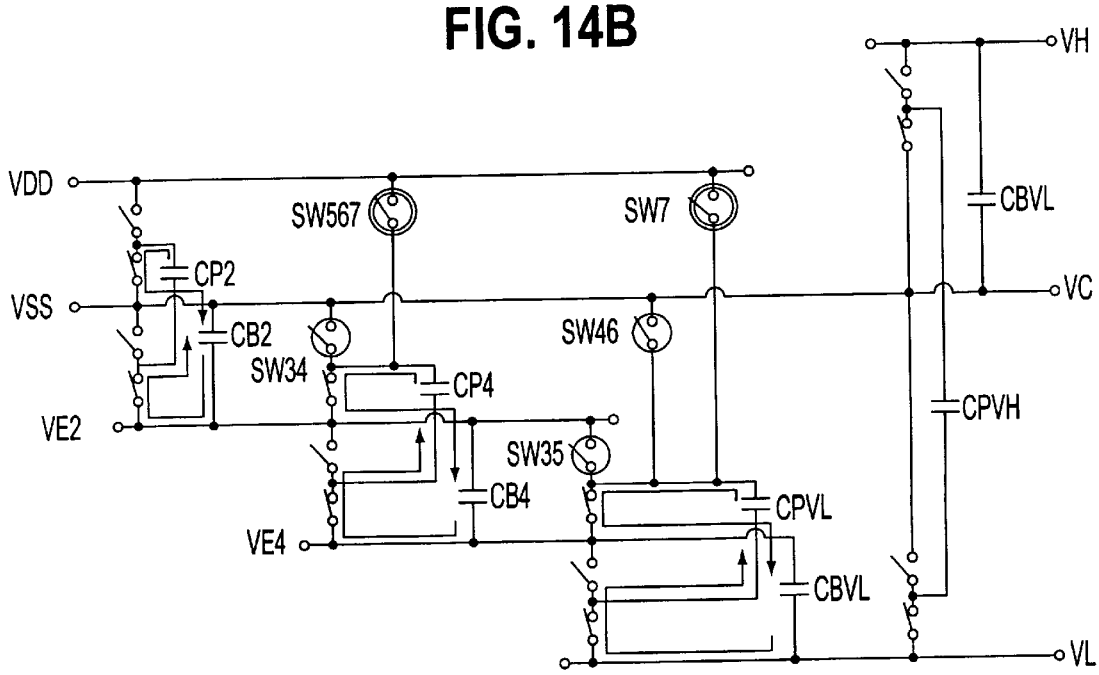

In the quadplex boosting (X4), as shown in FIGS. 14A and 14B, the switching elements SW34 and SW46 are ON-OFF controlled while the switching elements SW567, SW7 and SW35 are always the OFF state. Thus, the capacitors CP4 and CPVL will be charged respectively with VSS through paths I7 and I8. Unlike the case of FIGS. 11A and 11B, the paths to the capacitors CP4 and CPVL are changed from I1 and I2 to I7 and I8.

Figure 15A:
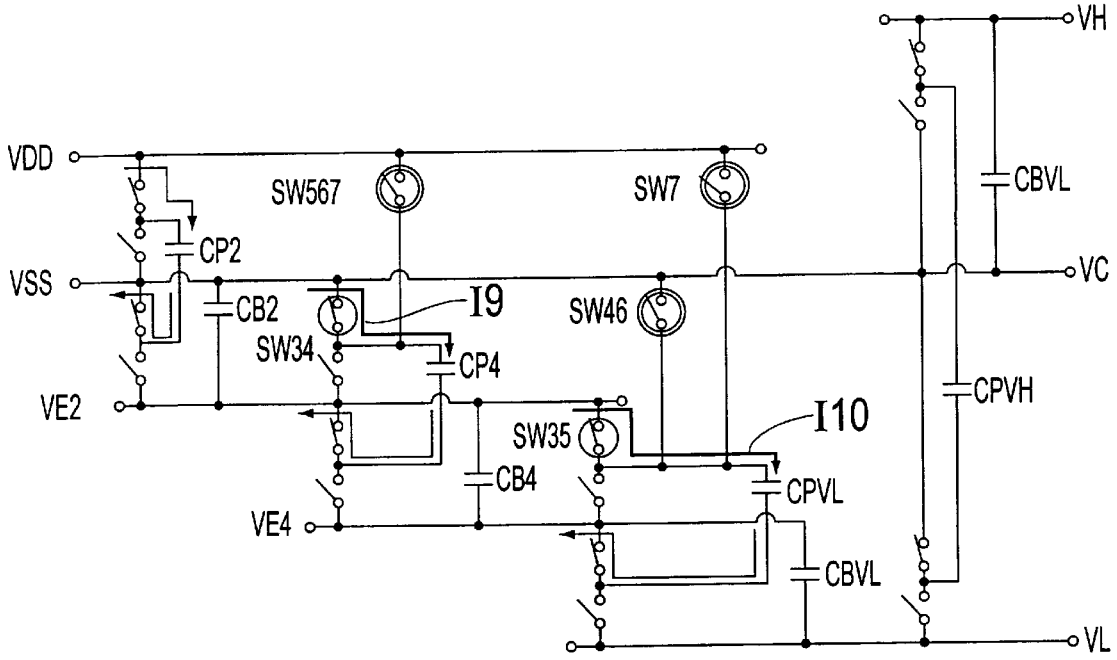
FIGS. 15A and 15B illustrate the detailed operation of the switching element on triplex boosting.
Figure 15B:
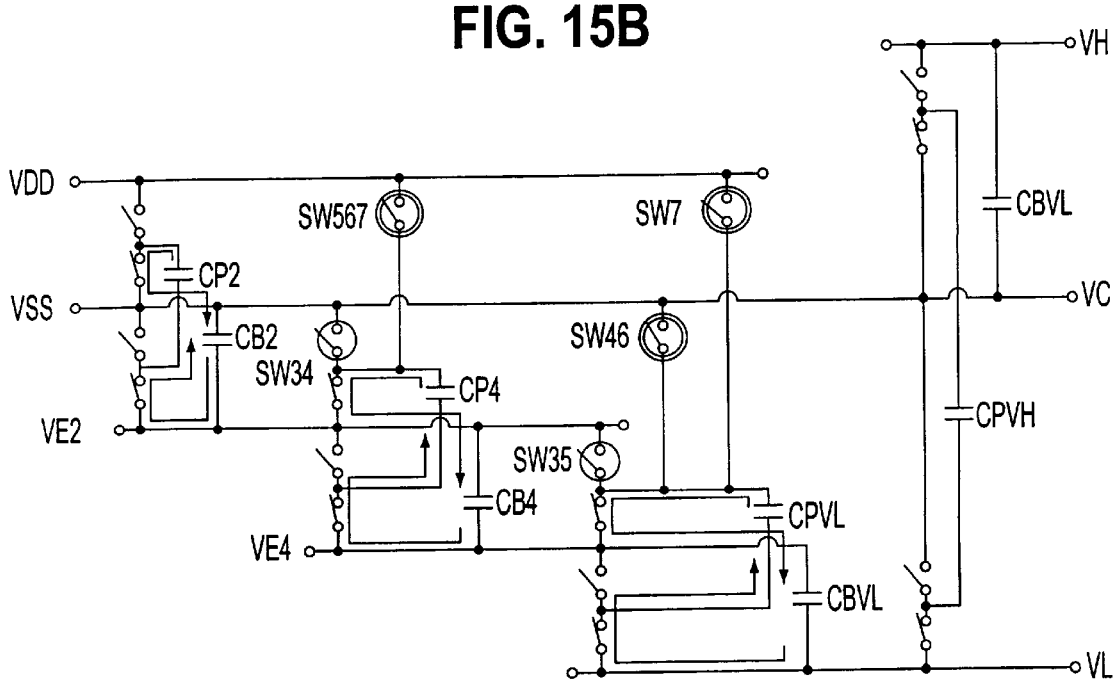

In the triplex boosting (X3), as shown in FIGS. 15A and 15B, the switching elements SW34 and SW35 are ON-OFF controlled while the switching elements SW567, SW7 and SW46 are always in the OFF state. Thus, the capacitors CP4 and CPVL will be charged respectively with VSS and VE2 through paths I9 and I10. Unlike the case of FIGS. 11A and 11B, the paths to the capacitors CP4 and CPVL are changed from I1 and I2 to I9 and I10.

In this embodiment, as described, the switching elements SW567 and SW34 are connected to different potentials VDD and VSS, the other end of each of these switching elements being connected to one end of the capacitor CP4. Depending on the boosting required, the switching element to be ON-OFF controlled is switched. More particularly, in the quintuplex, sextuplex and septuplex boostings, the switching element SW567 is ON-OFF controlled. In the triplex and quadplex boostings, the switching element SW34 is ON-OFF controlled. Similarly, the switching elements SW7, SW46 and SW35 are connected to different potentials VDD, VSS and VE2, the other end of each of these switching elements being connected to one end of the capacitor CPVL. In the septuplex boosting, the switching element SW7 is ON-OFF controlled. In the quadplex and sextuplex boostings, the switching element SW46 is ON-OFF controlled. In the triplex and quintuplex boostings, the switching element SW35 is ON-OFF controlled. In such a manner, the boosting ratio can variably be controlled while minimizing degradation of the display characteristics and increase of the chip area.

Figure 16:
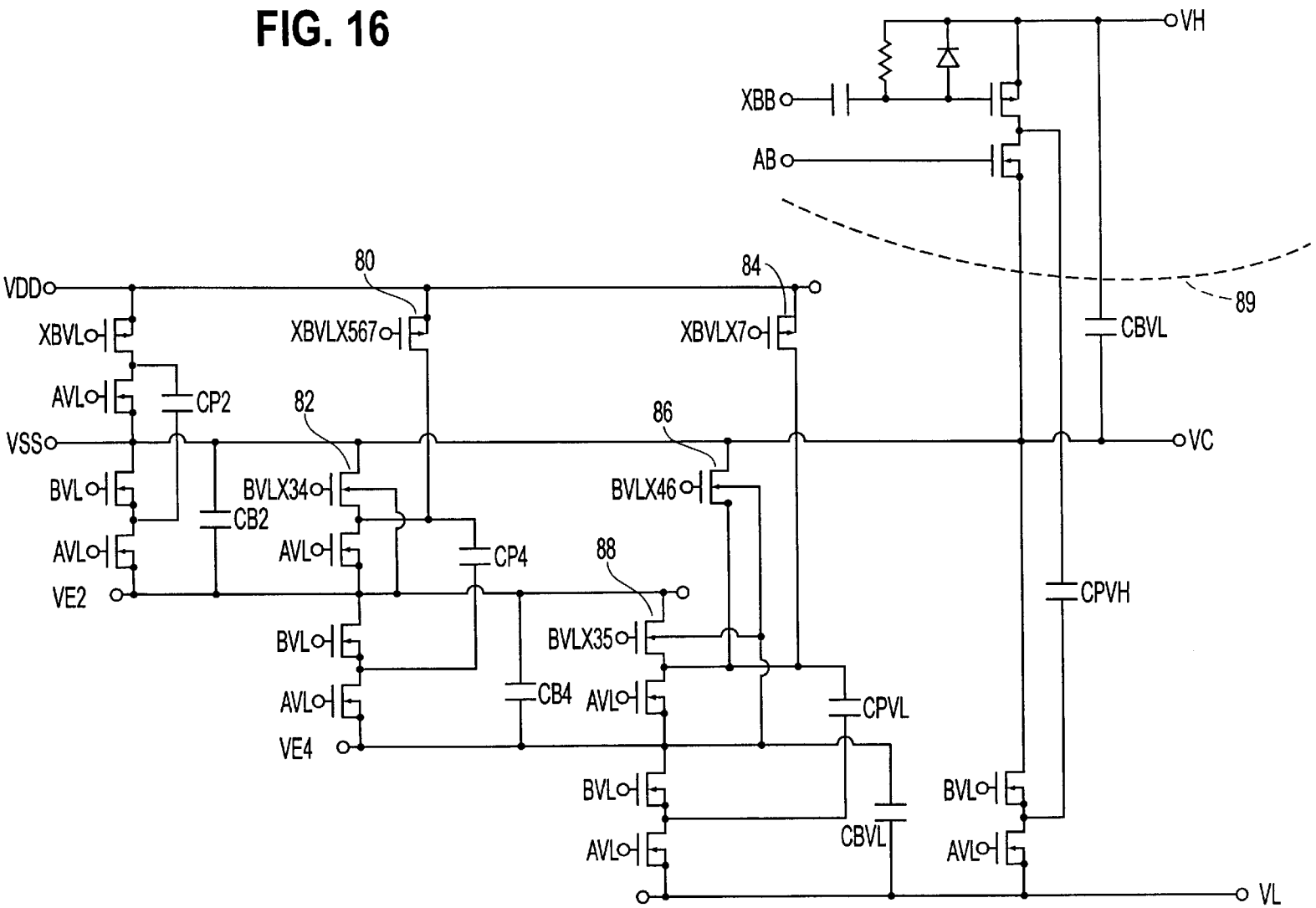
FIG. 16 is a diagram of the details of the charge pump section in the first embodiment.

FIG. 16 shows a power supply circuit constructed by using CMOS transistors according to this embodiment. Switching transistors 80, 82, 84, 86 and 88 used herein correspond to switching elements SW567, SW34, SW7, SW46 and SW35 shown in FIGS. 11A–15B, respectively. In FIG. 16, all the transistors are of N type except transistors connected to VDD and VH.

A portion of the circuit above a dotted line 89 in FIG. 16 is an external part of the IC in which the power supply circuit is formed.

Figure 17:
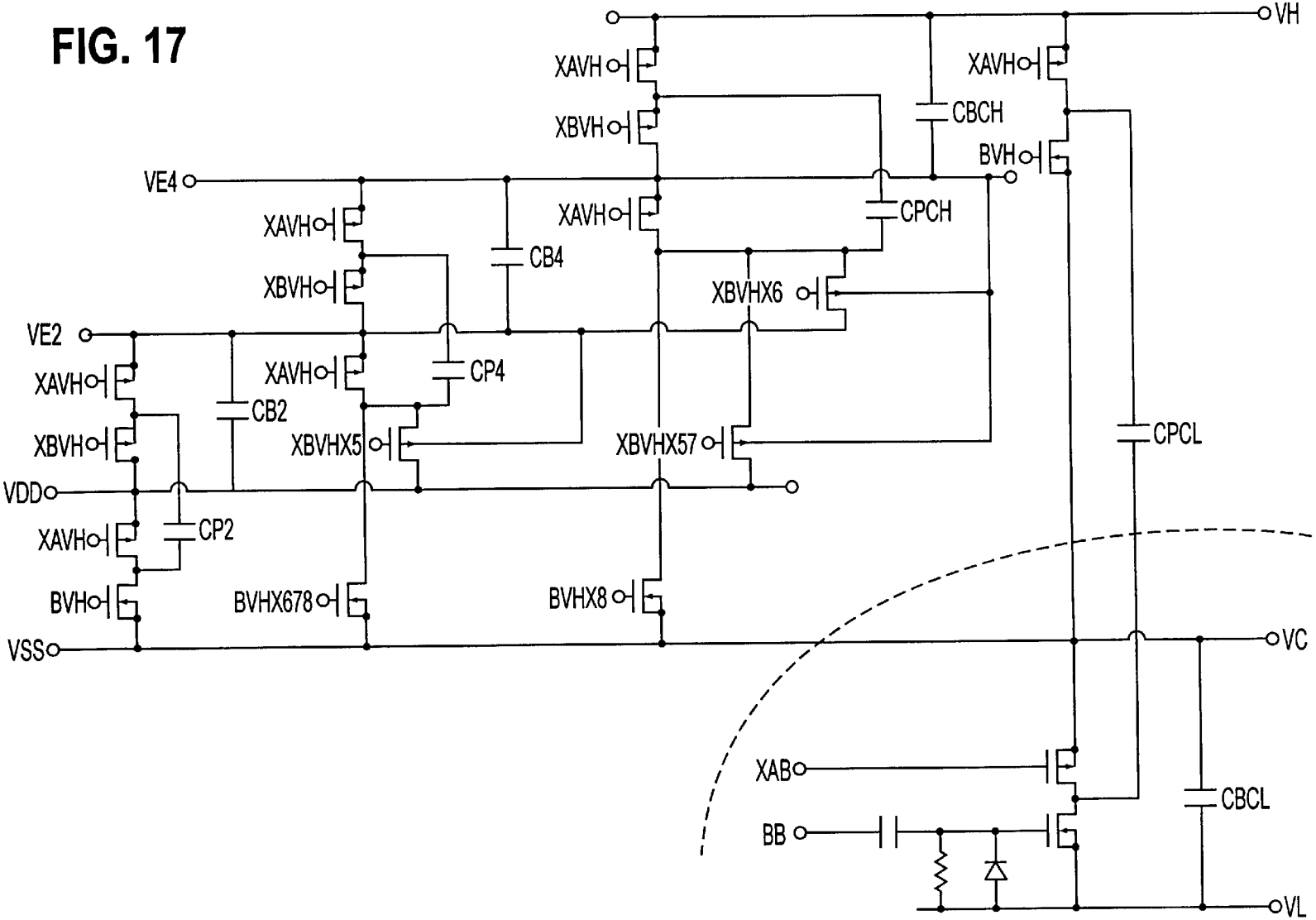
FIG. 17 is a diagram of the details of the charge pump section when P substrate is used.

The structure of FIG. 16 uses an N-type substrate having separate P-wells. Thus, N-type transistors each having its increased mobility can be used while the threshold voltage can be prevented from being increased due to the bias effect of the substrate (body effect). For example, with P-type substrate, the circuit structure may be as shown in FIG. 17. In the case of FIG. 17, potentials VE2, VE4 and VH are sequentially generated by positive boosting. The generated potential VH is boosted in the negative direction to provide the potential VL.

In FIG. 16, alphabet letters attached to switching signals which are to be inputted into the respective switching transistors at their gates have the following meaning:

AB Positive; A active; Amplitude B; always ON-OFF

XBB Negative; B active; Amplitude B; always ON-OFF

AVL Positive; A active; Amplitude VL; always ON-OFF

BVL Positive; B active; Amplitude VL; always ON-OFF

XBVL Negative; B active; Amplitude VL; always ON-OFF

BVLX34 Positive; B active; Amplitude VL; ON-OFF in triplex and quadplex boostings XBVLX567 Negative; B active; Amplitude VL; ON-OFF in quintuplex, sextuplex and septuplex boostings BVLX35 Positive; B active; Amplitude VL; ON-OFF in triplex and quintuplex boostings BVLX46 Positive; B active; Amplitude VL; ON-OFF in quadplex and sextuplex boostings XBVLX7 Negative; B active; Amplitude VL; ON-OFF in septuplex boosting The terms "A active" and "B active" respectively indicate that a switching element becomes active at timing A or B. The amplitudes B and VL respectively represent VDD−VSS and VDD−VL.

Figures 18, 18A:
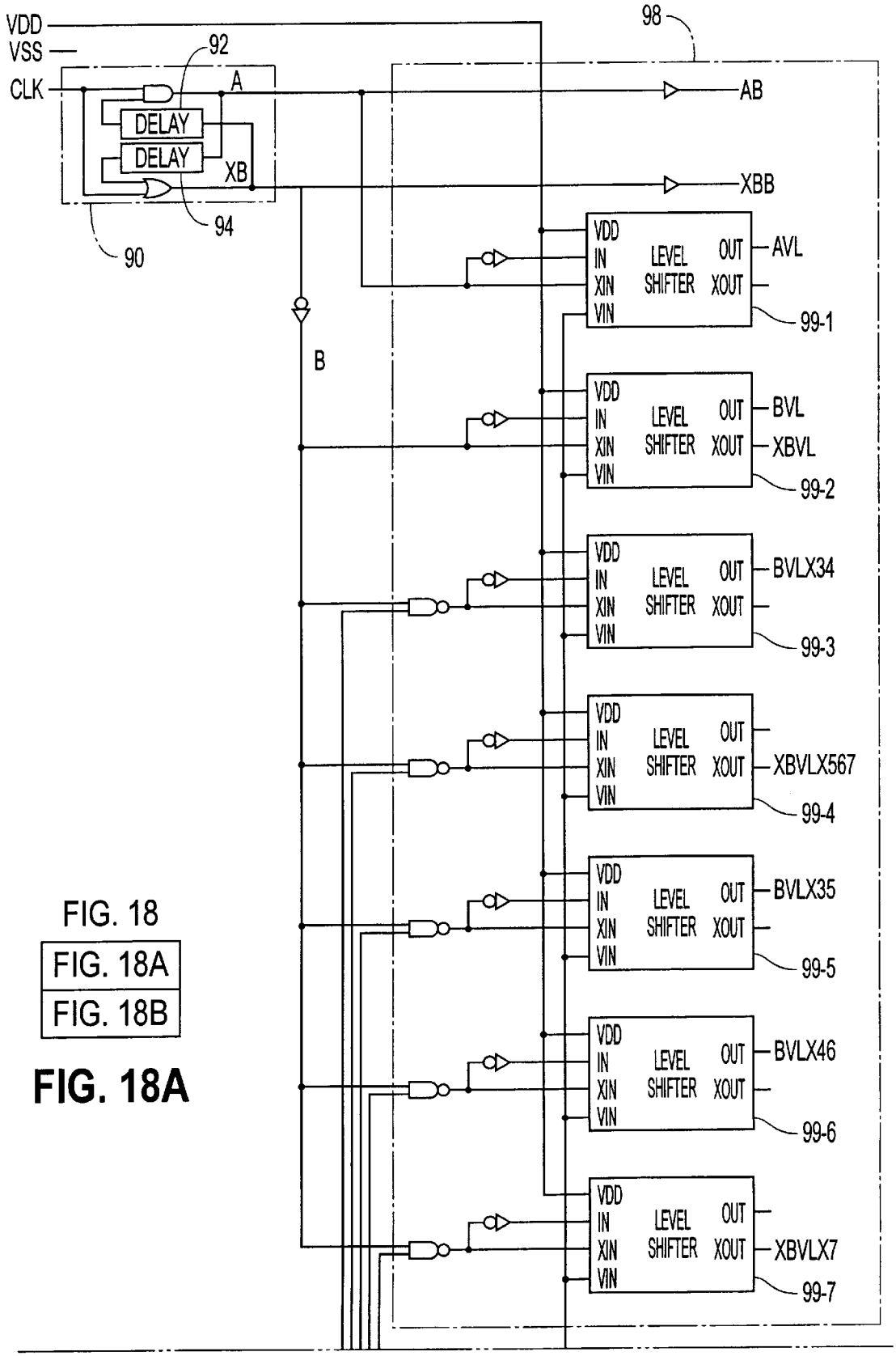
FIG. 18 is a diagram of the details of the switching signal generation circuit in the first embodiment.
Figure 18B:
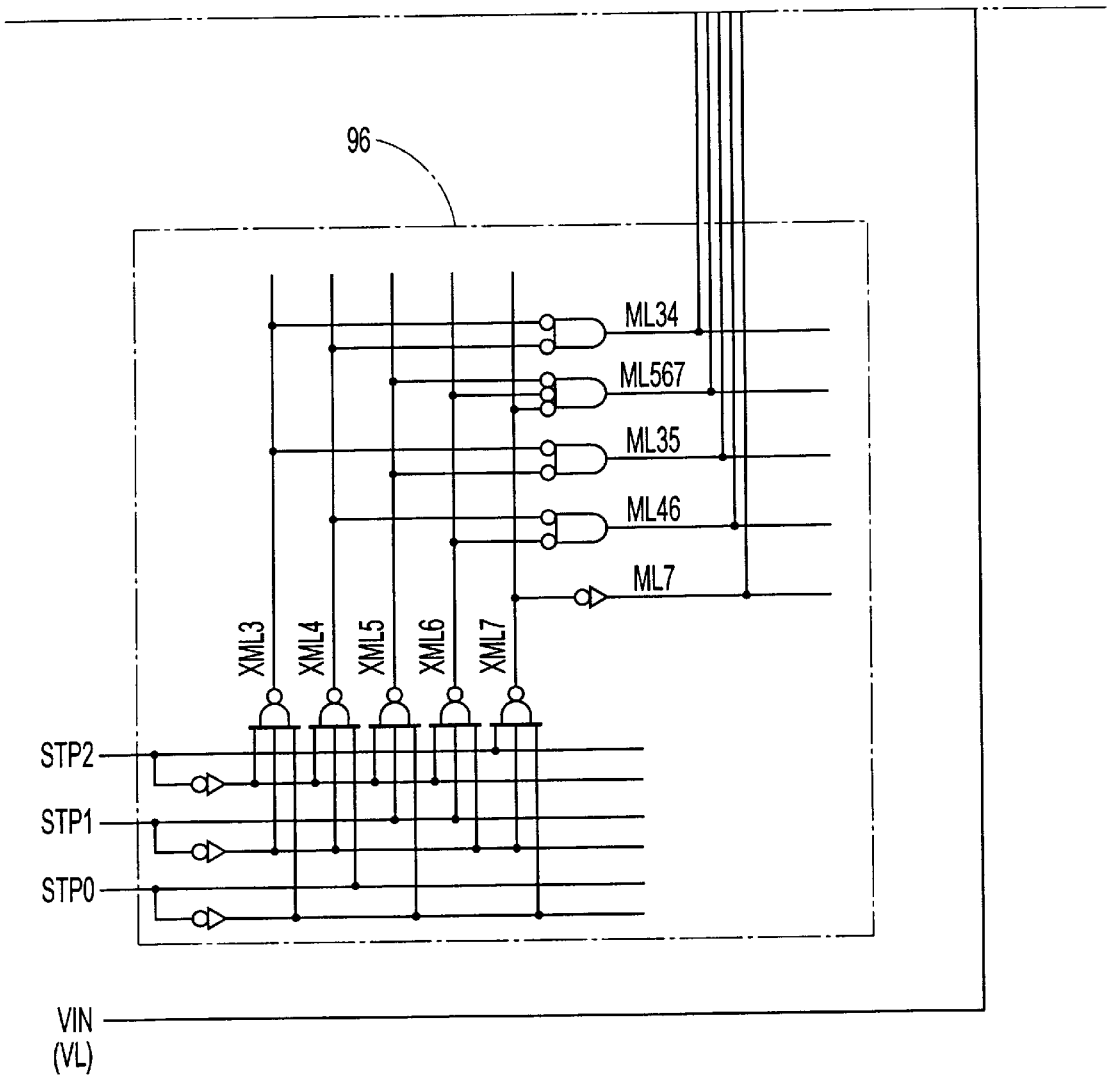

These switching signals are generated by the switching signal generation circuit 70 (see FIG. 8), the detailed structure of which being exemplified in FIG. 18. Waveforms of the switching signals in the septuplex, sextuplex, quintuplex, quadplex and triplex boostings are shown in FIGS. 19, 20, 21, 22 and 23, respectively.

As shown in FIG. 18, the switching signal generation circuit comprises a basic switching signal generation circuit 90 for generating basic switching signals A and B, a decoder 96 for decoding the boosting control signals STP0–STP2 to output signals ML34, ML567, ML35, ML46 and ML7 and an output circuit 98.

Figure 19:
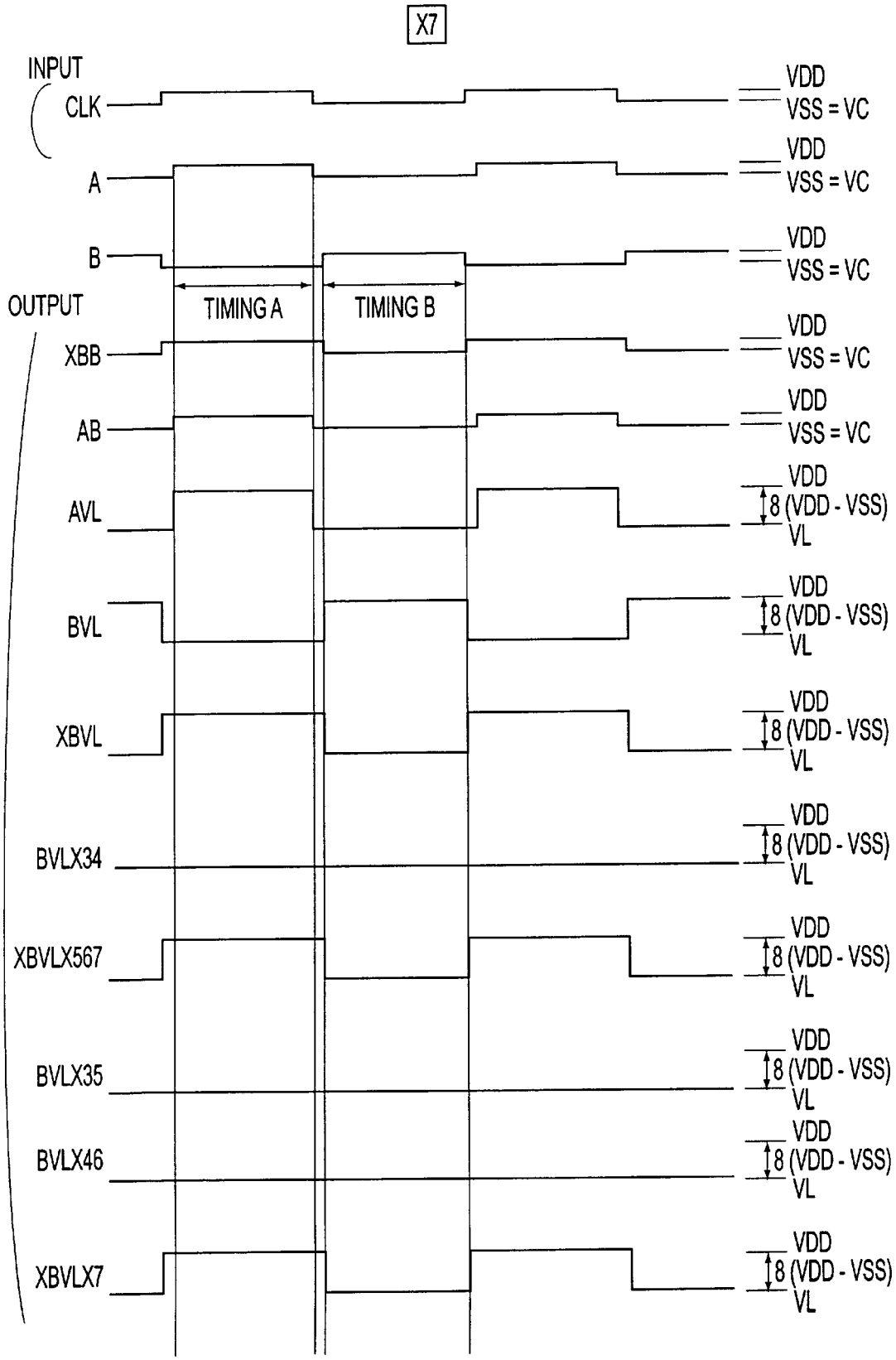
FIG. 19 shows waveforms of the switching signal on septuplex boosting.

The basic switching signal generation circuit 90 includes delay units 92 and 94 and generates such non-overlap basic switching signals A and B as shown in FIG. 19 based on the clock signal CLK. The signals A and B become active at the respective timings A and B.

When the decoder 96 decodes boosting control signals STP0–STP2 such that they respectively specify triplex boosting, quadplex boosting, quintuplex boosting, sextuplex boosting and septuplex boosting, the respective boosting control signals make signals XML3, XML4, XML5 XML6 and XML7 active. The decoder 96 further decodes these signals XML3, XML4, XML5 XML6 and XML7 to make the signals ML34, ML567, ML35, ML46 and ML7 active in the triplex and quadplex boostings; in the quintuplex, sextuplex and septuplex boostings; in the triplex and quintuplex boostings; in the quadplex and sextuplex boostings; and in the septuplex boosting.

The output circuit 98 receives the basic switching signals A and B and the output signals ML34-ML7 of the decoder 96 and then outputs switching signals generated based on the basic switching signals toward the switching elements to be ON-OFF controlled, and also outputs switching signals fixed at the potential VDD or VL toward switching elements not to be ON-OFF controlled.

Figure 24:
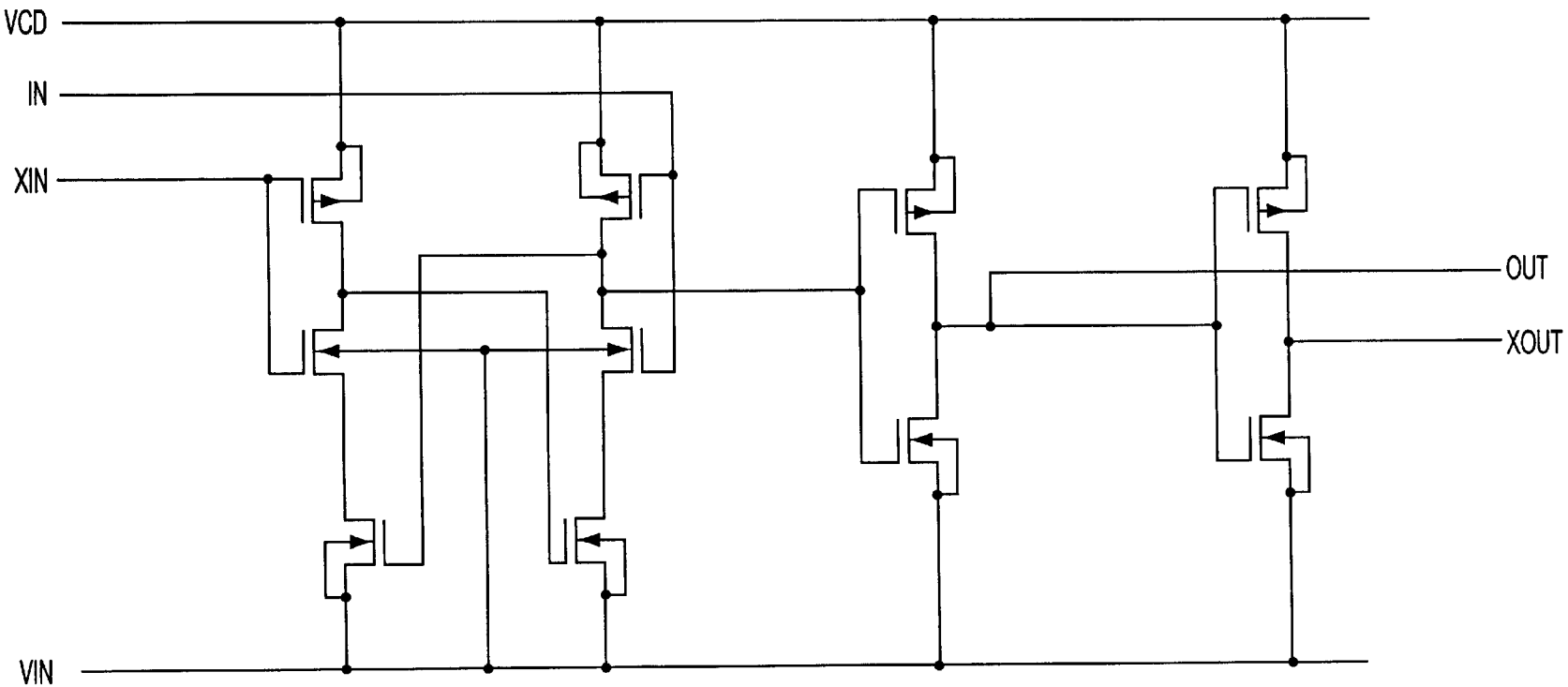
FIG. 24 shows a structure of the level sifter.

The output circuit 98 includes level shifters 99-1 to 99-7, the details of which are shown in FIG. 24. These level shifters 99-1 to 99-7 convert the amplitudes of the basic switching signals A and B based on the reference potential VDD and charge pump potential VL.

For example, in the septuplex boosting step, as shown in FIG. 19, the switching signals BVLX34, BVLX35 AND BVLX46 are fixed at the potential VL and the switching signal AVL and other signals are provided by converting the amplitude of the basic switching signal A or B into eight times by the level shifters.

Figure 20:
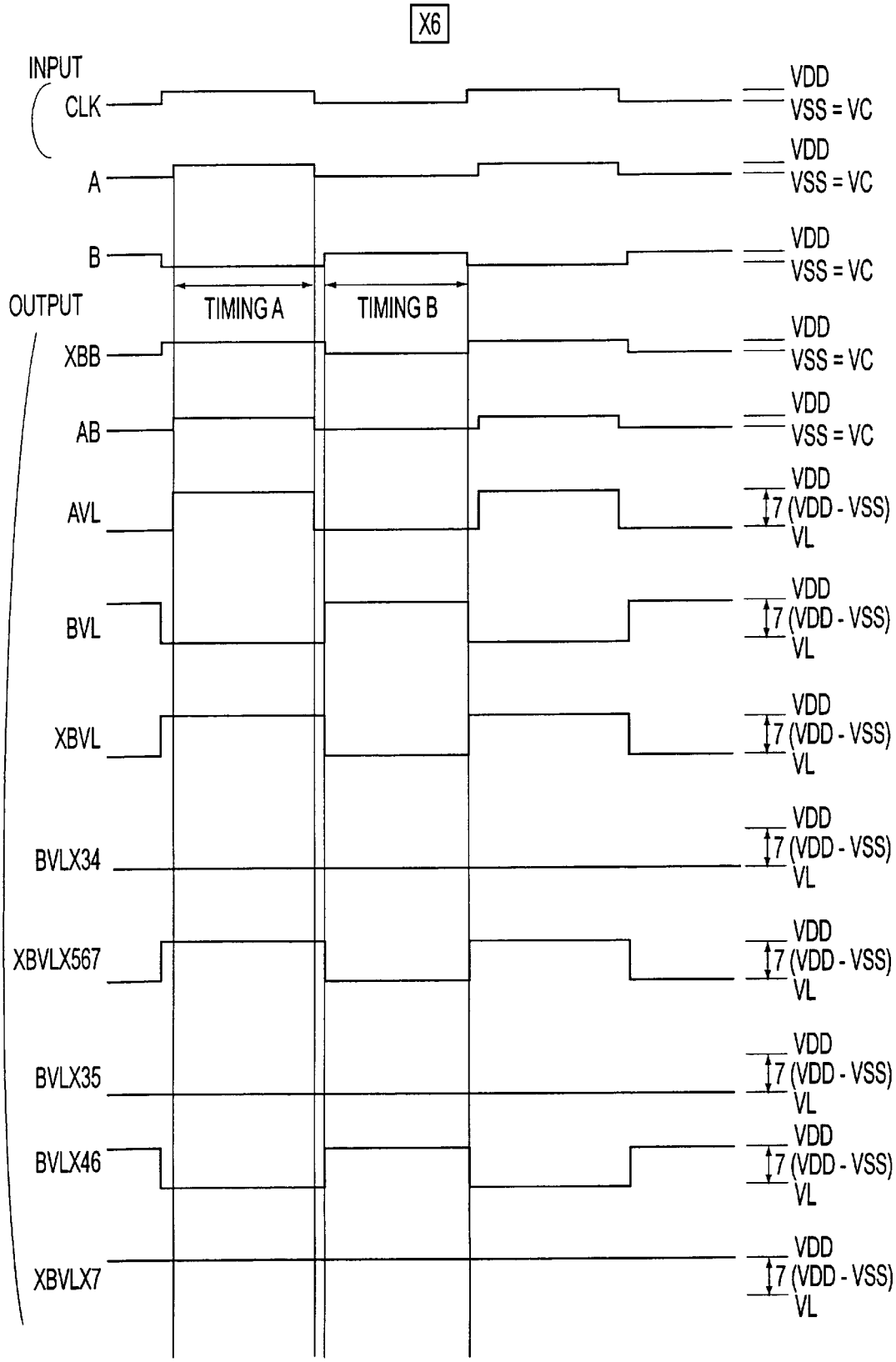
FIG. 20 shows waveforms of the switching signal on sextuplex boosting.

In the sextuplex boosting, as shown in FIG. 20, the switching signals BVLX34 and BVLX35 are fixed at the potential VL and the switching signal XBVLX7 is fixed at the potential VDD. The switching signal AVL and other switching signals are provided by converting the amplitude of the basic switching signal A or B into seven times by the level shifters.

Figure 21:
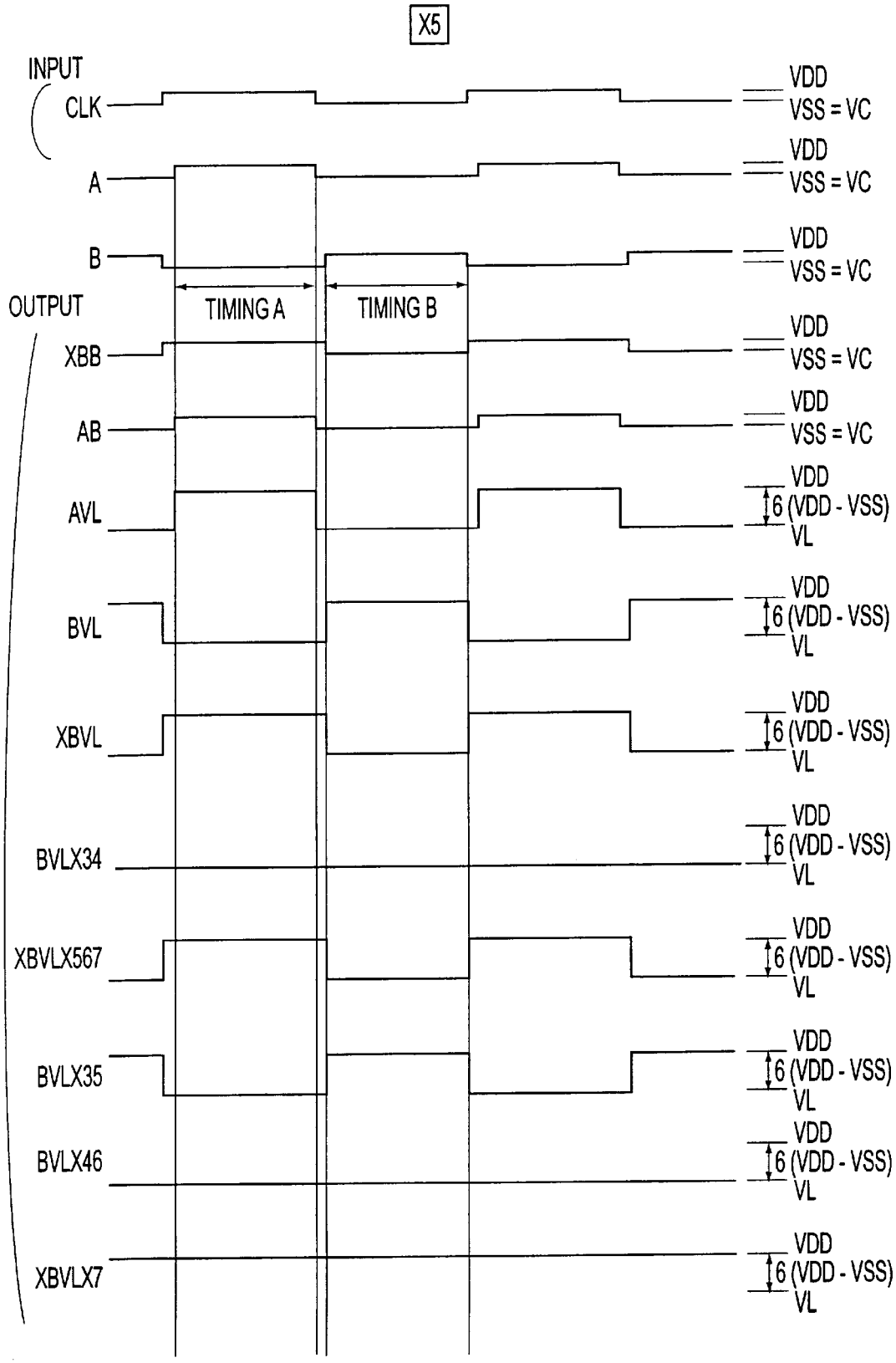
FIG. 21 shows waveforms of the switching signal on quintuple boosting.

In the quintuplex boosting, as shown in FIG. 21, the switching signals BVLX34 and BVLX4 are fixed at the potential VL and the switching signal XBVLX7 is fixed at the potential VDD. The switching signal AVL and other switching signals are provided by converting the amplitude of the basic switching signal A or B into six times by the level shifters.

Figure 22:
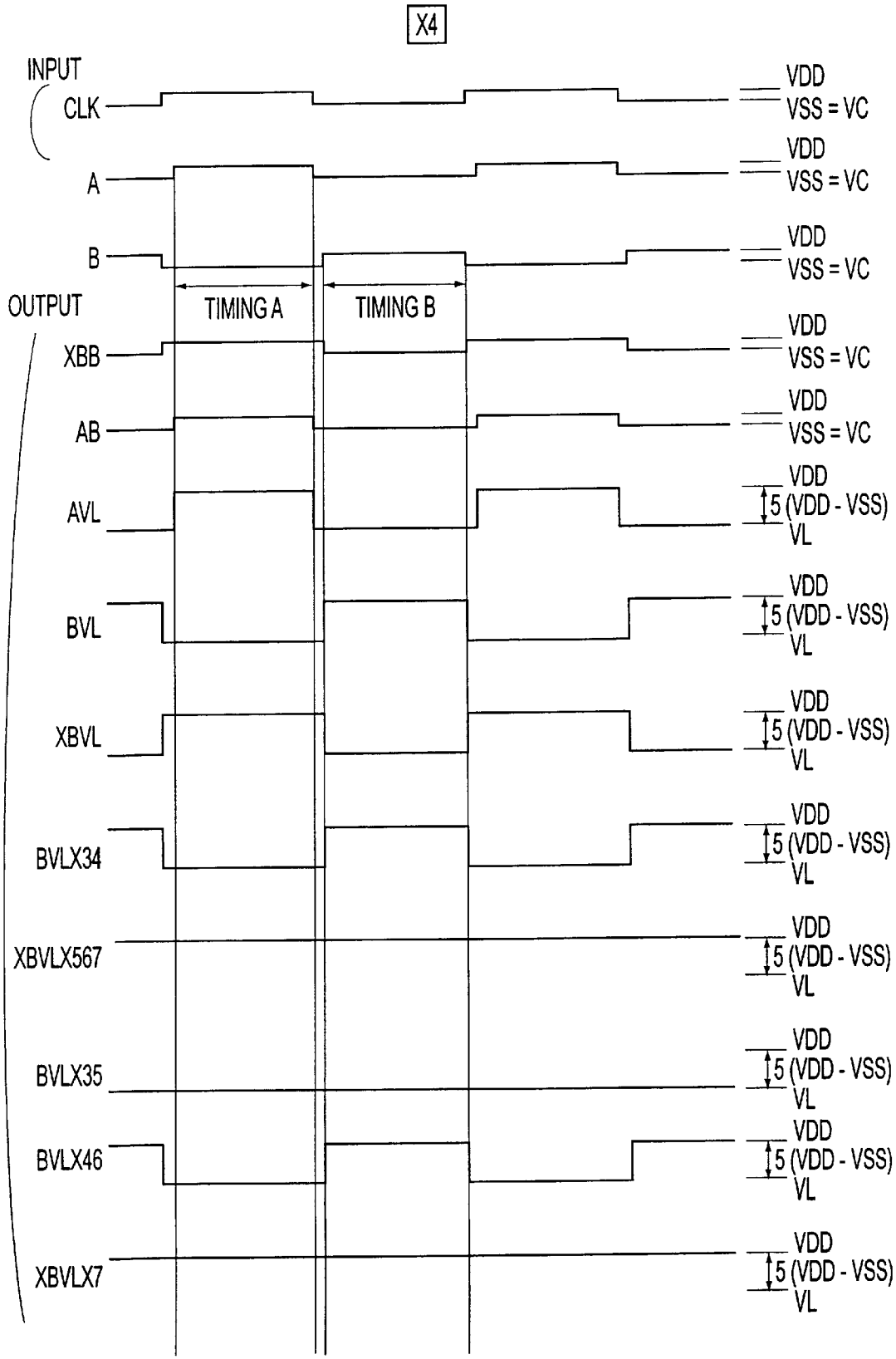
FIG. 22 shows waveforms of the switching signal on quadplex boosting.

In the quadplex boosting, as shown in FIG. 22, the switching signals BVLX35 is fixed at the potential VL and the switching signals XBVLX567 and XBVLX7 are fixed at the potential VDD. The switching signal AVL and other switching signals are provided by converting the amplitude of the basic switching signal A or B into five times by the level shifters.

Figure 23:
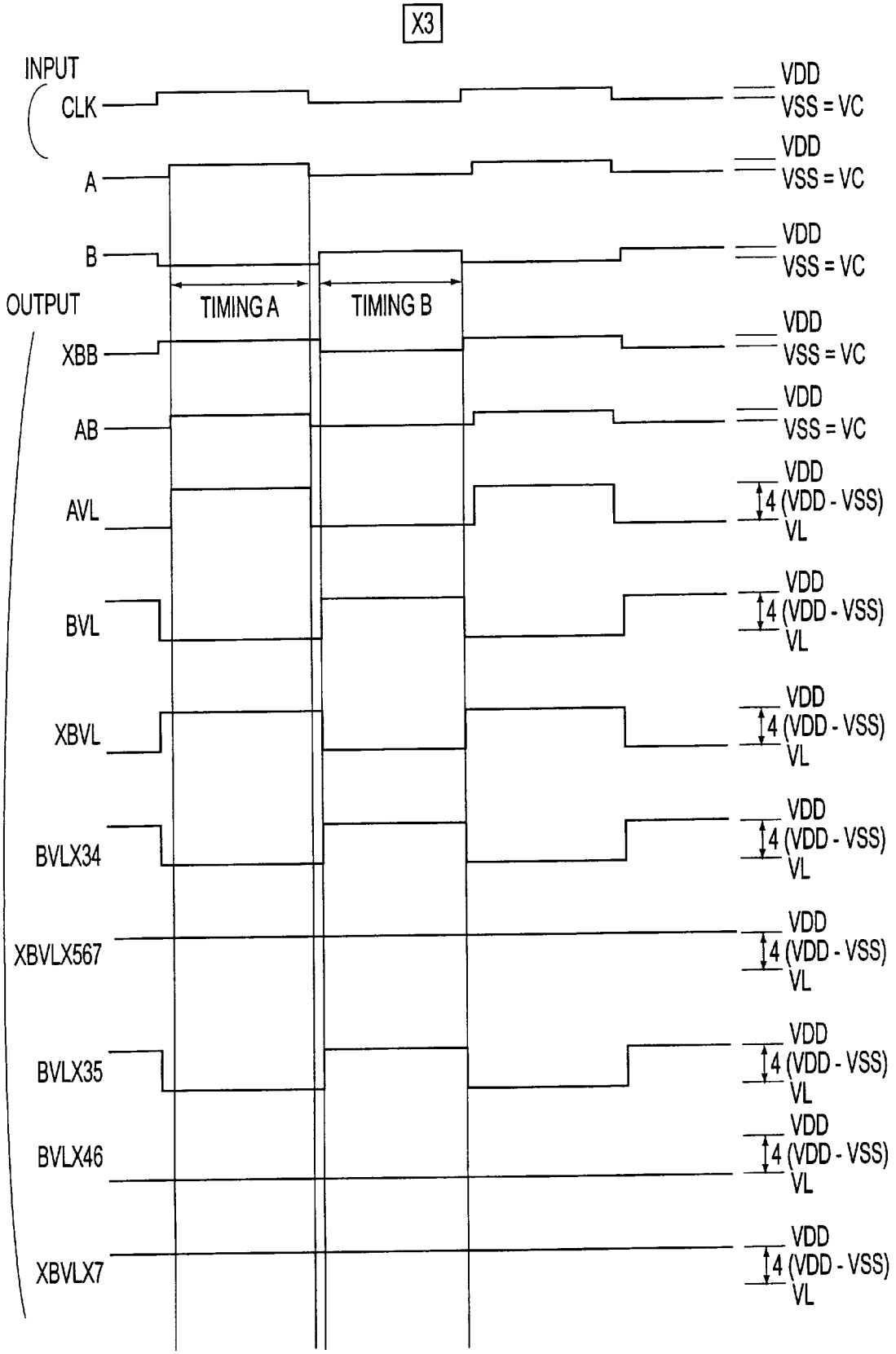
FIG. 23 shows waveforms of the switching signal on triplex boosting.

In the triplex boosting, as shown in FIG. 23, the switching signals BVLX46 is fixed at the potential VL and the switching signals XBVLX567 and XBVLX7 are fixed at the potential VDD. The switching signal AVL and other switching signals are provided by converting the amplitude of the basic switching signal A or B into four times by the level shifters.

As described, the boosting ratio can variably be controlled by generating the switching signals based on the boosting control signals STP0–STP2 through the switching signal generation circuit while minimizing degradation of the display characteristics and increase of the chip area. Thus, the power consumption of the power supply circuit itself can be reduced to prolong the battery service life with setting of the boosting ratio according to the duty ratio and with realization of the partial display through the reduced power consumption.

Second Embodiment

The second embodiment is to reduce the power consumption of the power supply circuit itself by setting the potential of a switching signal at a proper level during such a period (or OFF period) that a switching transistor is in its OFF state.

Figure 25:
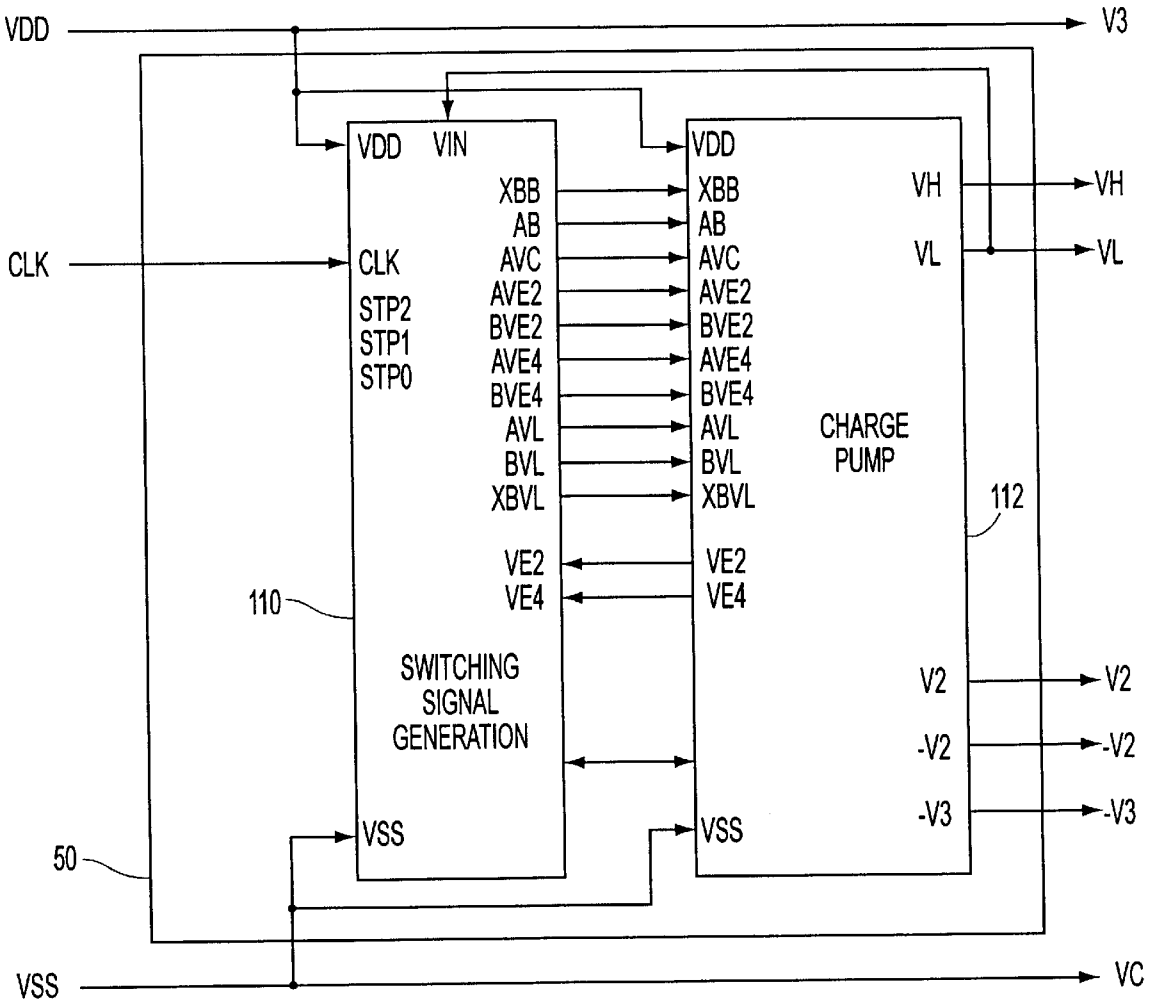
FIG. 25 is a block diagram of the overall structure of the second embodiment.

As shown in FIG. 25, a power supply circuit 50 according to the second embodiment comprises a switching signal generation circuit 110 and a charge pump unit 112. Unlike the case of FIG. 8, the potentials VE2 and VE4 in addition to the potential VL also are fed from the charge pump unit 112 back to the switching signal generation circuit 110. The switching signal generation circuit 110 is designed to generate the potential of a switching signal from the charge pump potentials VL, VE2 and VE4 and the reference potentials VDD and VSS during the OFF-state period.

Figure 26:
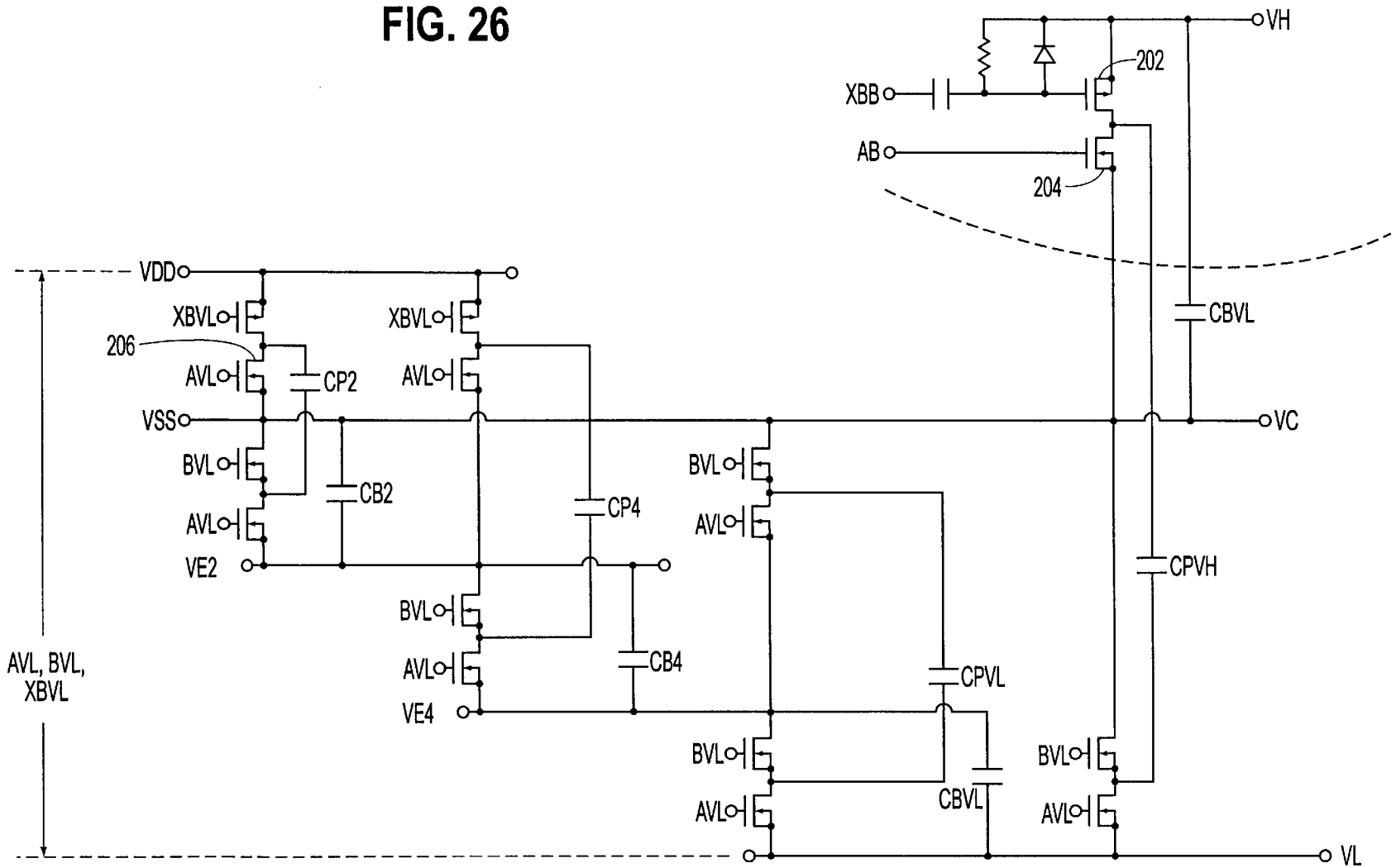
FIG. 26 shows a structure of the charge pump section using the conventional charge pump system.
Figure 27:
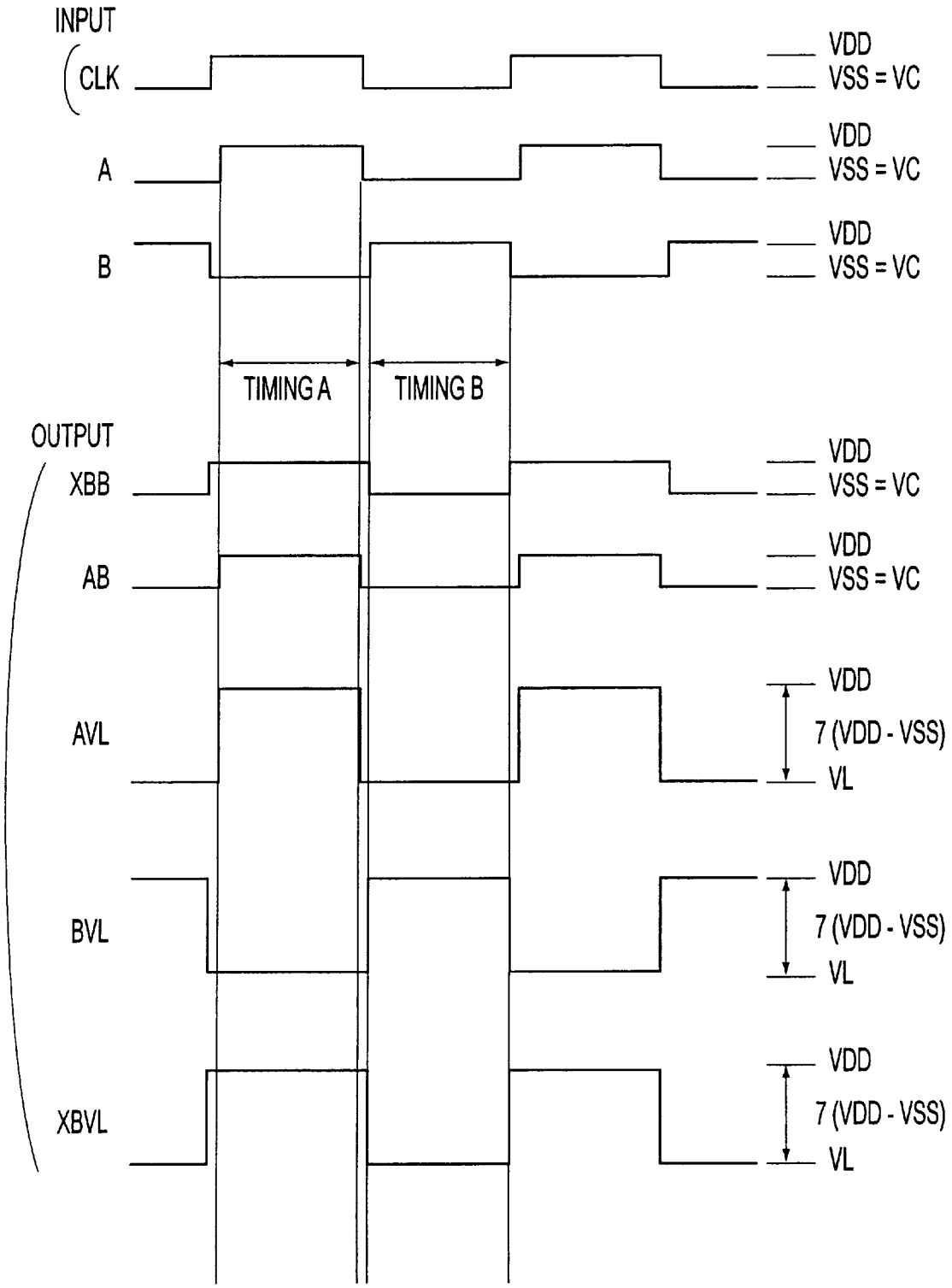
FIG. 27 shows waveforms of the switching signal in the circuit of FIG. 26.

FIG. 26 exemplifies a circuit which can obtain the potentials VH and VL through the conventional charge pump system while FIG. 27 shows waveforms of switching signals obtained by each of the switching transistors in such a circuit. In the circuit, a signal AVL, BVL or XBVL is provided to all the switching transistors except switching transistors 202 and 204 to which signals AB and XBB are provided. As shown in FIG. 27, each of the signals AVL, BVL and XBVL has a highest potential level equal to VDD, a lowest potential level equal to VL and an amplitude equal to 7(VDD−VSS). For example, with a switching transistor 206 of FIG. 26, its gate receives a switching signal AVL which is equal to VDD during the ON-state period and VL during the OFF-state period.

However, since VGS (gate-source voltage) must be smaller than VTH (threshold voltage) for such a purpose as turning the switching transistor 206 off, the potential of AVL during the OFF-state period is sufficient if it is lower than at least VSS+VTH (threshold voltage of the switching transistor 206). Therefore, the technique of FIG. 28A wherein the potential of AVL becomes equal to VL during the OFF-state period to apply any excess voltage to between the gate and the source leads to any unnecessary power consumption.

Figure 28A:
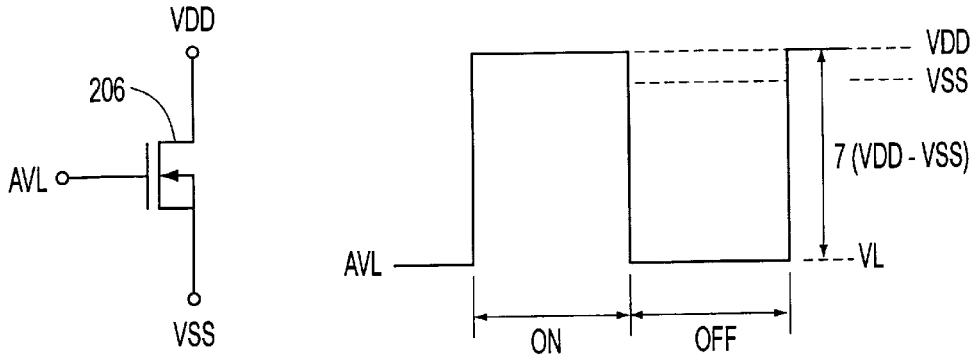
FIGS. 28A, 28B and 28C illustrate the operations of the second embodiment.

The power consumption P in a CMOS transistor is mainly dominated by signal clock frequency f, parasitic capacity C such as gate capacity or wiring capacity and signal amplitude V. This can be represented by $P=fCV^2$. Therefore, the technique of FIG. 28A which the amplitude V becomes equal to 7(VDD−VSS) during the OFF-state period will unnecessarily consume the power. In the power supply circuit of the charge pump system, it is particularly required to reduce the ON-resistance of a switching transistor for lowering the output impedance. For such a purpose, the prior art used a huge switching transistor having its channel length of 4 $\mu$m and its channel width of several tens mm. The gate capacity of such a hugh switching transistor is very large. In the technique of FIG. 28A in which the amplitude of a signal driving the gate is large, the power consumption will highly be increased due to the gate capacity.

Figure 29:
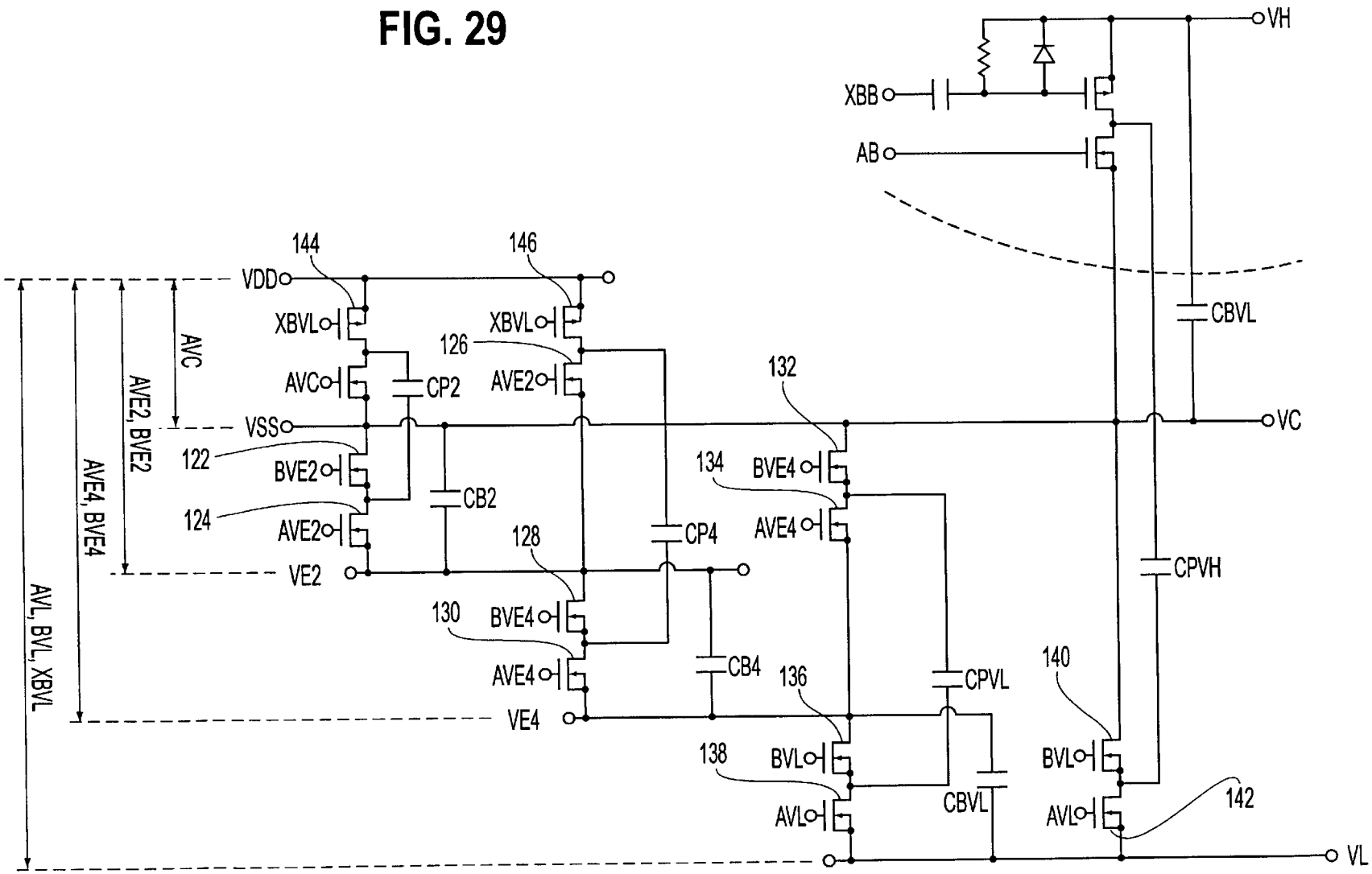
FIG. 29 shows the details of the charge pump section in the second embodiment.
Figure 30:
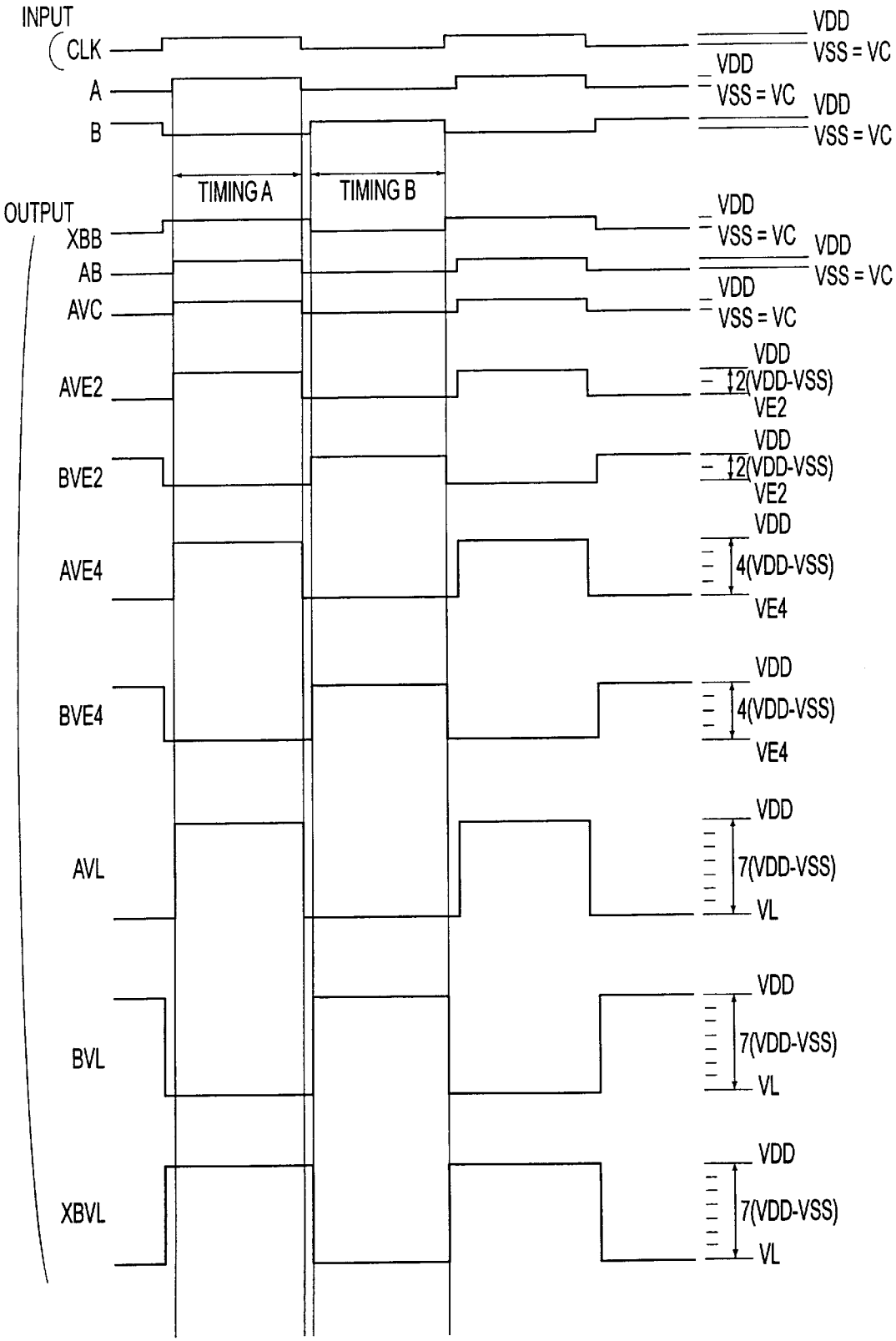
FIG. 30 shows waveforms of the switching signal of the second embodiment.

In order to overcome such a problem, the second embodiment provides such a structure as shown in FIG. 29. FIG. 30 shows waveforms of switching signals provided to the respective switching transistors.

The structure of FIG. 26 is different from that of FIG. 29 in that the structure of FIG. 26 provides a switching signal AVL, BVL or XBVL having its amplitude of VDD−VL=7 (VDD−VSS) to all the switching transistors except the switching transistors 202 and 204 while the structure of FIG. 29 provides a switching signal having the optimum amplitude to each of the switching transistors.

For example, a switching signal AVC having its amplitude (VDD−VSS) as shown in FIG. 30 may be provided to a switching transistor 120.

Switching transistors 122, 124 and 126 may receive a signal AVE2 or BVE2 having its amplitude VDD−VE2=2 (VDD−VSS).

Switching transistors 128, 130, 132 and 134 may receive a signal AVE4 or BVE4 having its amplitude VDD−VE4= 4(VDD−VSS).

Switching transistors 136, 138, 140, 142, 144 and 146 may receive a signal BVL or XBVL having its amplitude VDD−VL=7(VDD−VSS).

Figure 28B:
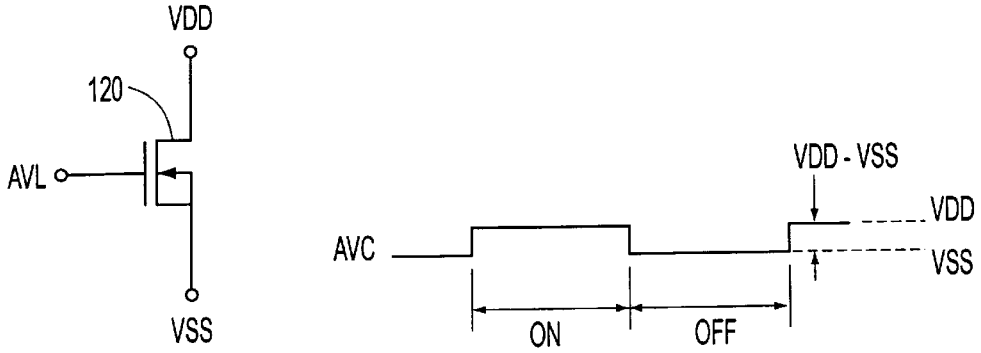

In other words, as shown in FIG. 28B, the gate of the switching transistor 120 may receive a switching signal AVC which becomes VDD during the ON-state period and VSS during the OFF-state period. Namely, the potential of the switching signal during the OFF-state period is equal to the potential VSS supplied to the source of the switching transistor 120.

The gates of switching transistors 122 and 124 may receive switching signals BVE2 and AVE2 which become VDD during the ON-state period and VE2 during the OFF-state period. In other words, the potential of the switching signal during the OFF-state period is equal to the potential VE2 supplied to the sources of the switching transistors 122 and 124.

Figure 28C:
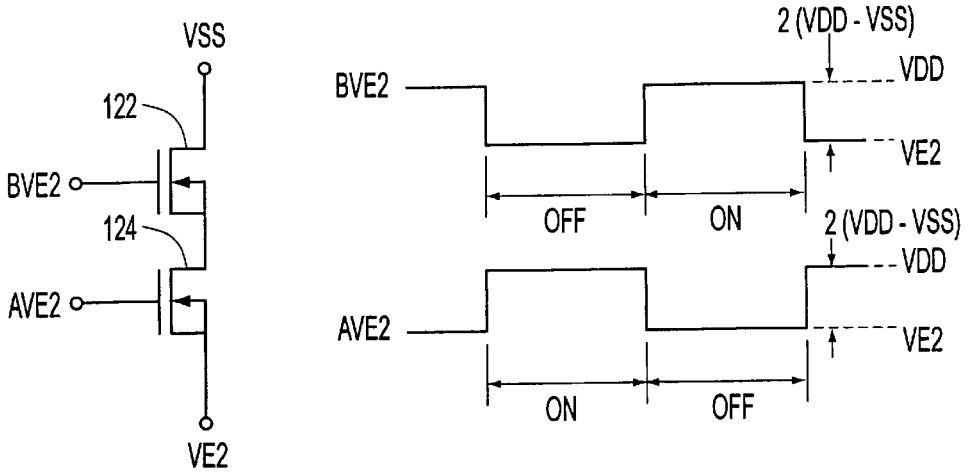

As described, in this embodiment, the potential of the switching signal during the OFF-state period is equal to the potential supplied to the source of the switching transistor. Thus, the condition of VGS (gate-source voltage)<VTH (threshold voltage) may be satisfied to turn the switching transistors off at a proper time during the OFF-state period. Although in the structure of FIG. 28A, an excess voltage is applied to between the gate and the source to provide the unnecessary power consumption during the OFF-state period, the structures of FIGS. 28B and 28C cause the minimum voltage required to turn the switching transistors off to between the gate and the source during the OFF-state period. Thus, the unnecessary power consumption can be minimized. This can reduce the power consumption in the power supply circuit itself. Display device or electronic instrument using such a power supply circuit can also be reduced in power consumption and improved in battery service life.

In FIG. 29, alphabet letters representing switching signals inputted into the gate of each switching transistor have the following meaning:

AB Positive; A active; Amplitude B; always ON-OFF

XBB Negative; B active; Amplitude B; always ON-OFF

AVC Positive; A active; Amplitude VC; always ON-OFF

AVE2 Positive; A active; Amplitude VE2; always ON-OFF

BVE2 Positive; B active; Amplitude VE2; always ON-OFF

AVE4 Positive; A active; Amplitude VE4; always ON-OFF

BVE4 Positive; B active; Amplitude VE4; always ON-OFF

AVL Positive; A active; Amplitude VL; always ON-OFF

BVL Positive; B active; Amplitude VL; always ON-OFF

XBVL Negative; B active; Amplitude VL; always ON-OFF

The amplitudes B and VC represent that they are VDD–VSS, and the amplitudes VE2, VE4 and VL represent that they are respectively VDD–VE2, VDD–VE4 and VDD–VL.

Figure 31:
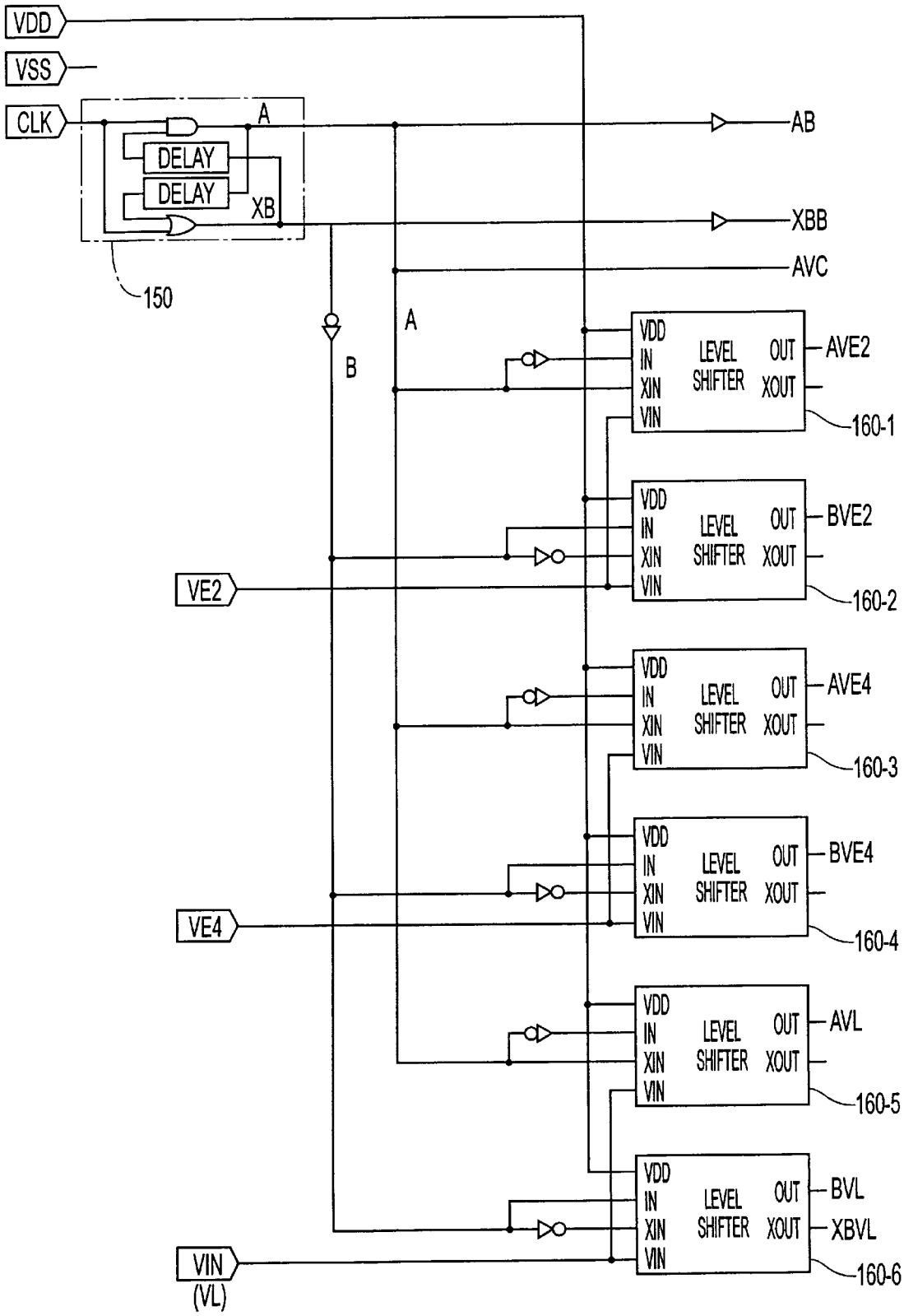
FIG. 31 is a block diagram of the switching signal generation circuit in the second embodiment.

These switching signals are generated by the switching signal generation circuit 110 (see FIG. 25), the structure of which is exemplified in FIG. 31. As shown in FIG. 31, the switching signal generation circuit 110 comprises a basic switching signal generation circuit 150 for generating the basic switching signals A and B and level shifters 160-1 to 160-6.

The level shifters 160-1 and 160-2 convert the amplitudes of the basic switching signals A and B into output switching signals AVE2 and BVE2 based on the reference potential VDD and the charge pump potential VE2.

The level shifters 160-3 and 160-4 convert the amplitudes of the basic switching signals A and B into output switching signals AVE4 and BVE4 based on the reference potential VDD and the charge pump potential VE2 different from the above-mentioned potential VE2.

The level shifters 160-5 and 160-6 convert the amplitudes of the basic switching signals A and B into output switching signals AVL, BVL and XBVL based on the reference potential VDD and the charge pump potential VL different from the aforementioned potentials VE2 and VE4.

The feature of this embodiment is thus to select a proper potential usable during the switching signal OFF-state period from the charge pump potentials VE2, VE4 and VL from the charge pump circuits and to generate the switching signals AVE2 and others. In other words, this embodiment is aimed at the presence of VE2 and VE4 provided on generation of the final boosting potential VL and effectively utilizes these potentials VE2 and VE4 during the switching signal OFF-state period.

In this embodiment, the potential of the switching signals during the switching transistor ON-state period VDD since the capacity of the transistor for supplying the current increases as the voltage between the ate and the source of that transistor increases during the ON-state period. However, if it precedes that the power consumption is reduced, it is desirable that the potential of the switching signals also be reduced during the ON-state period.

Third Embodiment

Figure 32:
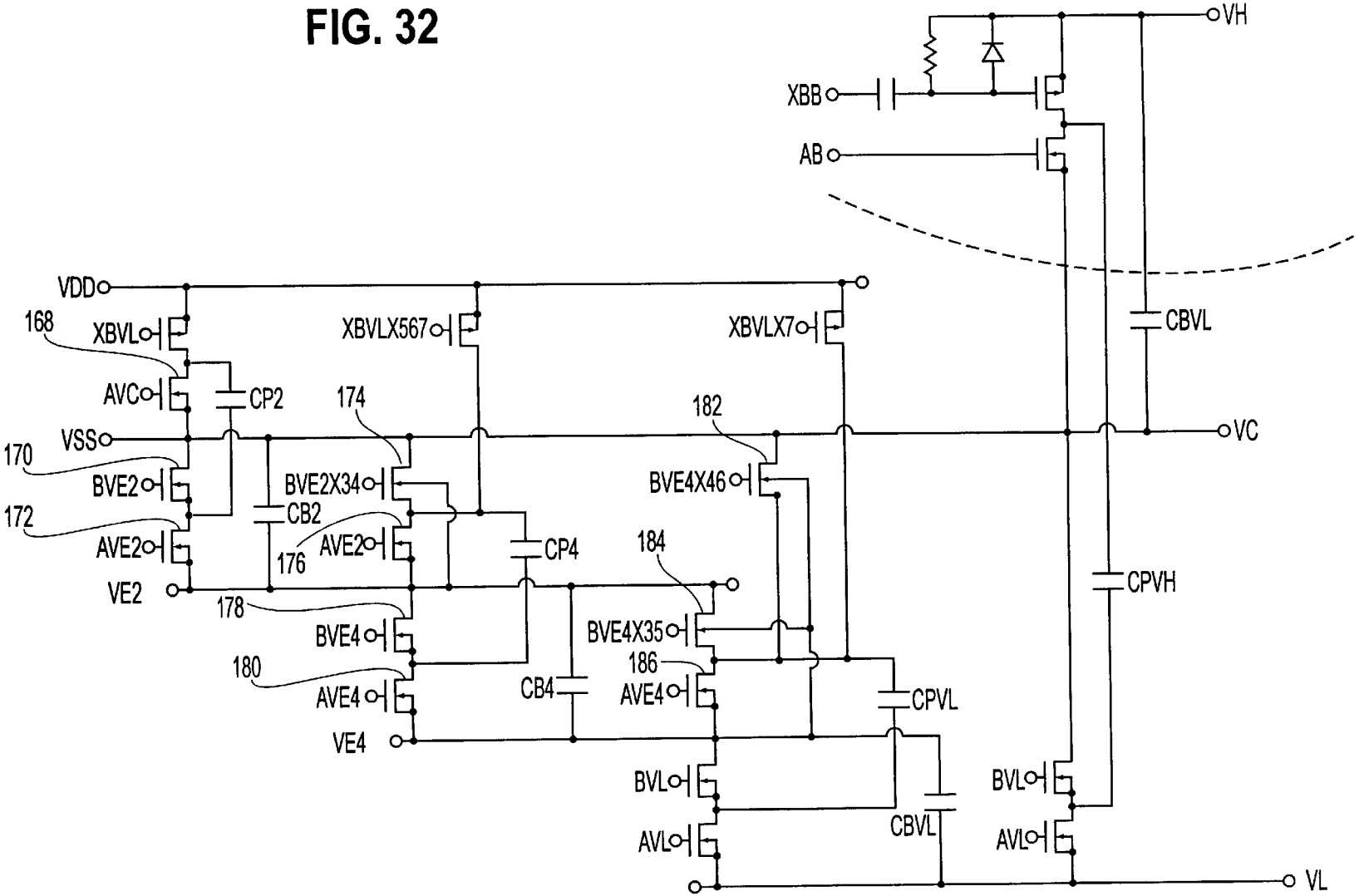
FIG. 32 shows the details of the charge pump section in the third embodiment.

The third embodiment is a combination of the first embodiment with the second embodiment. A structure of the third embodiment is shown in FIG. 32. In FIG. 32, alphabet letters attached to switching signals inputted to the gate of each switching transistor have the following meaning:

AB Positive; A active; Amplitude B; always ON-OFF

XBB Negative; B active; Amplitude B; always ON-OFF

AVL Positive; A active; Amplitude VL; always ON-OFF

BVL Positive; B active; Amplitude VD; always ON-OFF

AVC Positive; A active; Amplitude VC; always ON-OFF

XBVL Negative; B active; Amplitude VL; always ON-OFF

AVE2 Positive; A active; Amplitude VE2; always ON-OFF

BVE2 Positive; B active; Amplitude VE2; always ON-OFF

AVE4 Positive; A active; Amplitude VE4; always ON-OFF

BVE4 Positive; B active; Amplitude VE4; always ON-OFF

BVE2X34 Positive; B active; Amplitude VE4; ON-OFF in triplex and quadplex boostings XBVLX567 Negative; B active; Amplitude VL; ON-OFF in quintuplex, sextuplex and septuplex boostings BVE4X35 Positive; B active; Amplitude VE4; ON-OFF in triplex and quintuplex boostings BVE4X46 Positive; B active; Amplitude VE4; ON-OFF in quadplex and sextuplex boostings XBVLX7 Negative; B active; Amplitude VL; ON-OFF in septuplex boosting In the first embodiment of FIG. 16, a switching signal having its amplitude of VDD–VL is applied to all the switching transistors except some switching transistors. On the contrary, the structure of FIG. 32 applies a switching signal AVC having its amplitude of VDD–VSS to a switching transistor 168. Similarly, switching transistors 170, 172, 174 and 176 receive switching signals BVE2, AVE2, BE2X34 and AVE2 each having its amplitude of VDD–VE2. Switching transistors 178, 180, 182, 184 and 186 receive switching signals BVE4, AVE4, BVE4X35, AVE4 and AVE4 each having its amplitude of VDD–VE4. As described in connection with the second embodiment, thus, the unnecessary power consumption in the power supply circuit itself can be reduced. In addition, the third embodiment can further reduce the power consumption in the power supply circuit itself since the optimum boosting ration can be set depending on the duty ratio.

Figures 33, 33A:
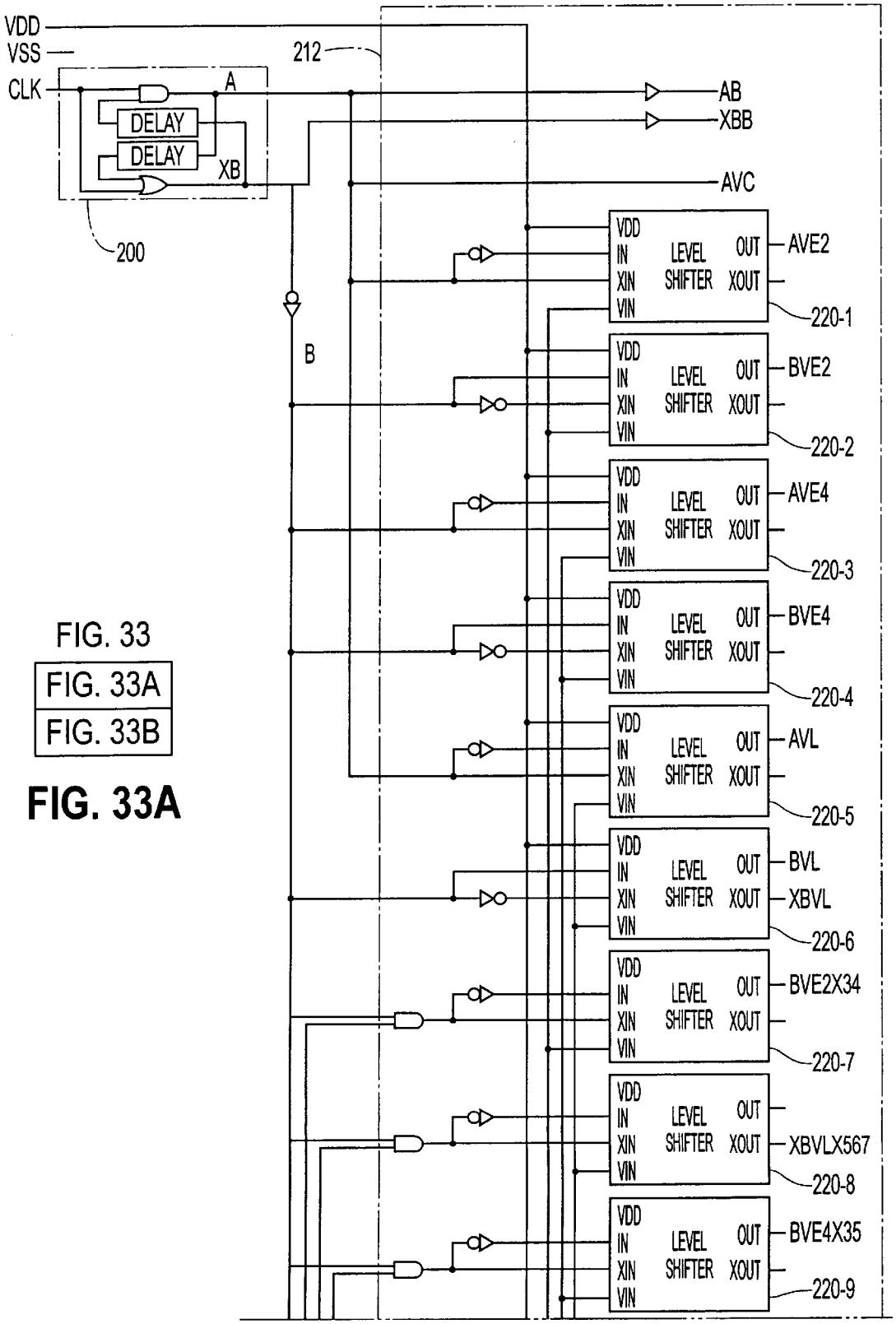
FIG. 33 shows the details of the switching signal generation circuit in the third embodiment.
Figure 33B:
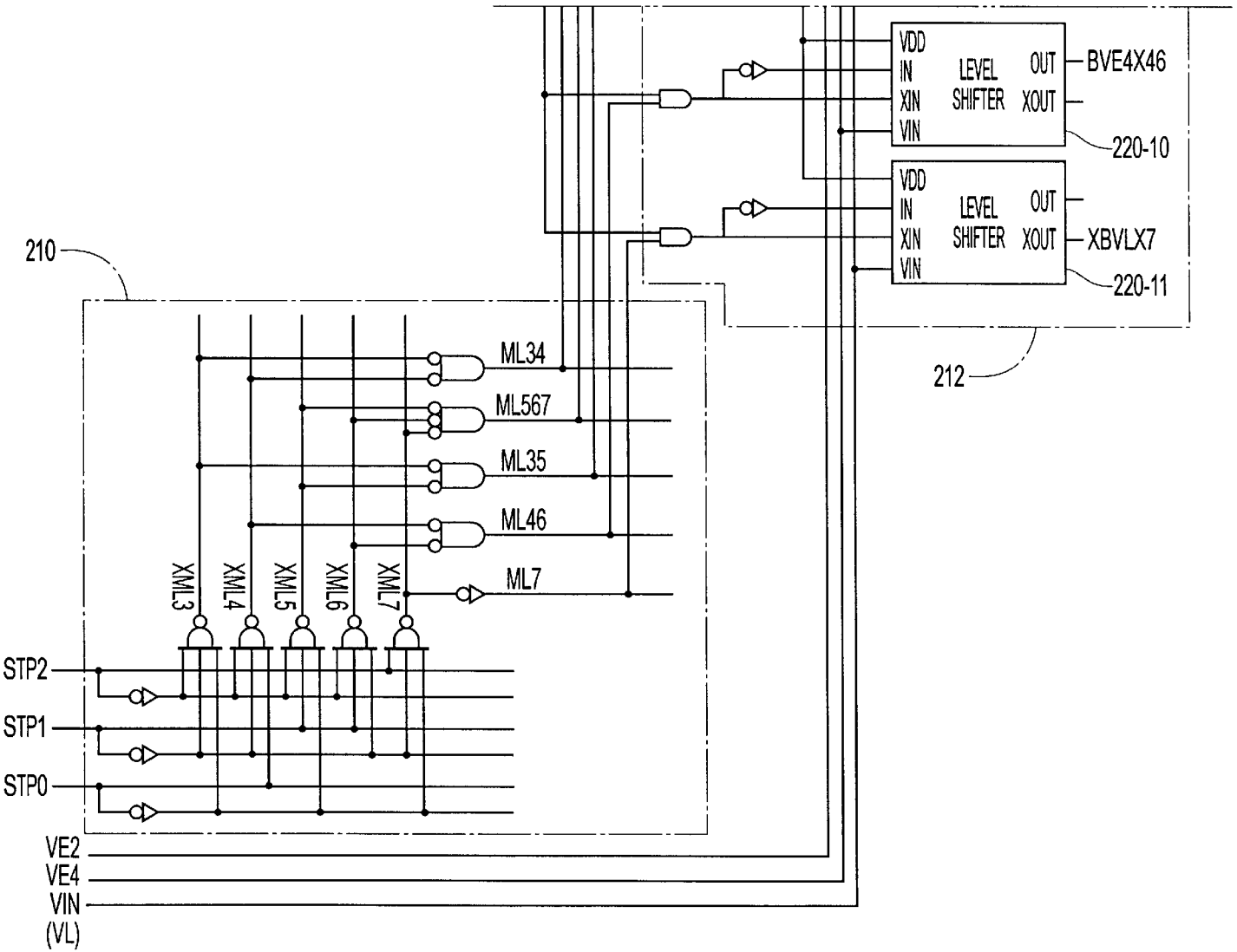

FIG. 33 shows an example of the structure of the switching signal generation circuit according to the third embodiment. The switching signal generation circuit comprises a basic switching signal generation circuit 200, a decoder 210 and an output circuit 212. The structure of FIG. 33 is largely different from that of the first embodiment shown in FIG. 18 in that the charge pump potentials VE2, VE4 and VL are to be inputted into the output circuit 212. Thus, each of level shifters 220-1 to 220-11 in the output circuit 212 can generate such a switching signal as the potential thereof during the OFF-state period is equal to a potential supplied to the source of the corresponding switching transistor. As described in connection with the second embodiment, therefore, it can be prevented that an excess voltage is applied to between the gate and the source during the OFF-state period. This can reduce the power consumption in the power supply circuit itself.

Fourth Embodiment

The fourth embodiment relates to an electronic instrument which utilizes the power supply circuit and display device as according to the first, second and third embodiments. A structure according to the fourth embodiment is shown in FIG. 34.

Figure 34:
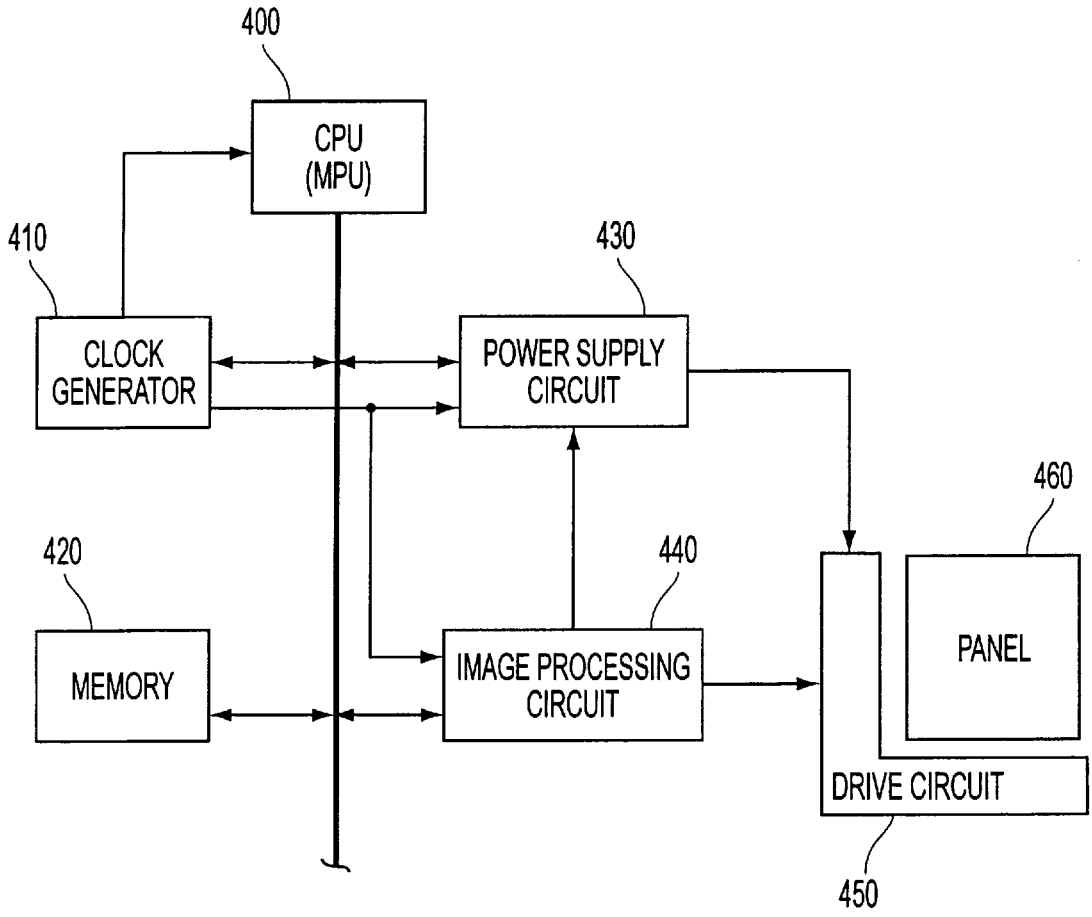
FIG. 34 is a block diagram of an electronic instrument of the fourth embodiment.

The electronic instrument of FIG. 34 comprises a CPU (MPU) 400, a clock generator 410, a memory (ROM and RAM) 420, a power supply circuit 430 as according to the first, second and third embodiments, an image processing circuit (display controller) 440, a drive circuit 450 and a panel 460. The image processing circuit 440 receives an instruction from the CPU 400, a clock signal from the clock generator 410, image information from the memory 420 and others to perform various necessary procedures for image display. Such procedures include a control process for the power supply circuit 430 and drive circuit 450, a gamma control process and others. The drive circuit 450 includes scan drivers, data drivers and the like for driving the panel 460. The power supply circuit 430 supplies the power to all the aforementioned circuits.

Boosting control signal (first control signal) and display control signal (second control signal) are set, for example, by a software operating on the CPU 400 (central control means). These control signals will be outputted toward the power supply circuit 430 directly from the CPU 400 or through the image processing circuit 400 instructed by the CPU 400.

Such an electronic instrument may be any one of various devices such as portable telephones (cellular phones), PHSs, pagers, printers, audio instruments, electronic notebooks, pocket calculators, POS terminals, touch panel devices, projectors, word processors, personal computers, TVs, viewfinder or monitor type video tap recorders, and car navigation devices.

Figure 35A:
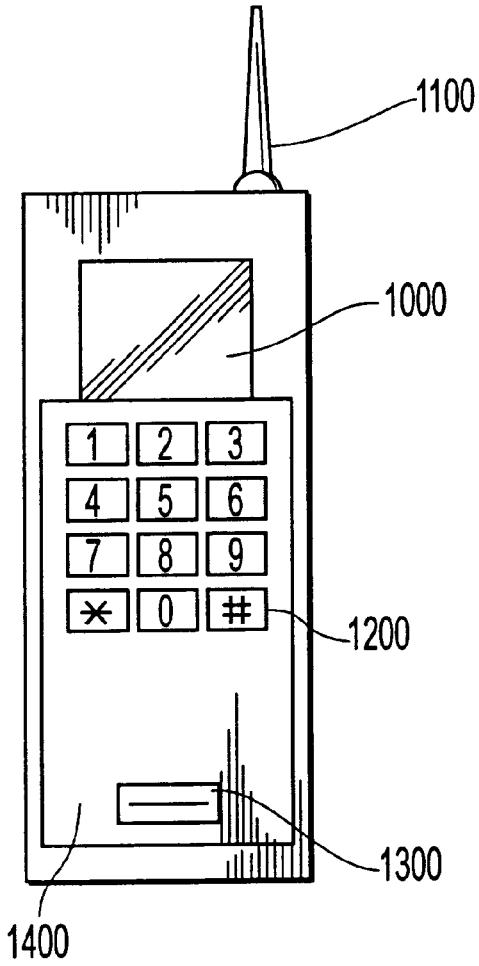
FIGS. 35A and 35B are front views of a portable telephone which is one of electronic instruments, in its normal and special modes.
Figure 35B:
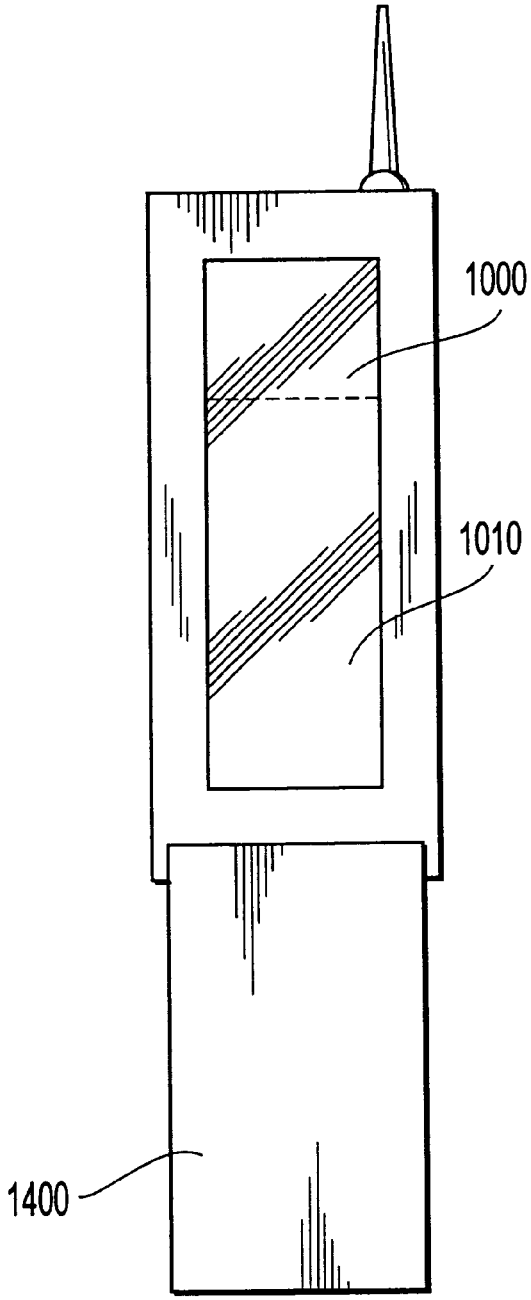

FIG. 35A shows the outline of the electronic instrument in the form of a portable telephone while FIG. 35B shows the outline of such a portable telephone when it is used as a portable terminal.

The portable telephone comprises screens 1000, 1010, an antenna 1100 and a control panel 1400 on which touch keys 1200 and a microphone 1300 are mounted.

As will be apparent from FIGS. 35A and 35B, on normal use, the screen 1010 hides under the control panel 1400. On the normal use, therefore, the screen 1010 is turned off by the use of display control signals (DOFF0–DOFF7 in FIG. 6).

When the telephone is to be used as a portable terminal, the control panel 1400 is turn down to expose the screen 1010. In such a situation, the screen 1010 is turned on. Therefore, both the screens 1000 and 1010 are used to display various types of information.

Figure 36A:
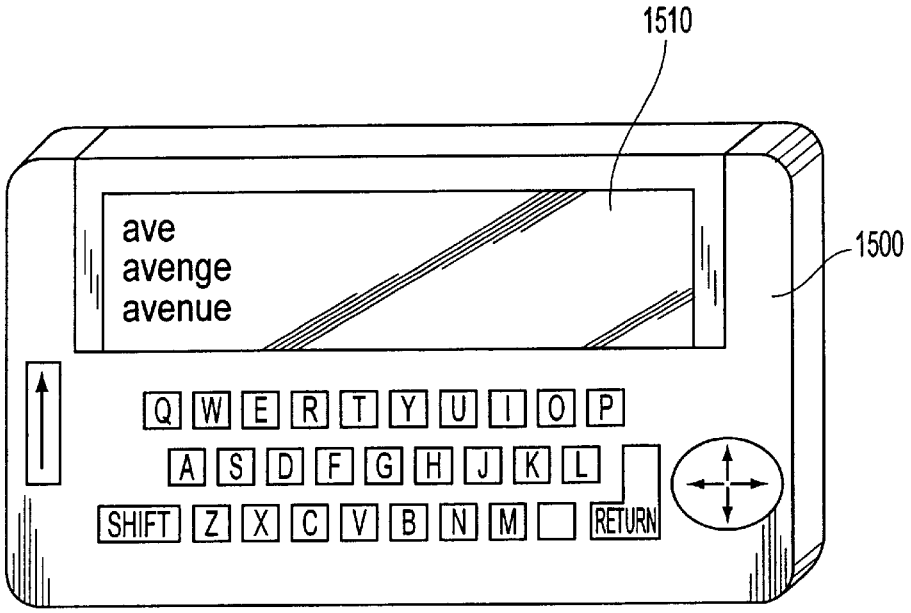
FIGS. 36A and 36B are perspective views of a portable electronic dictionary which is one of electronic instruments.
Figure 36B:
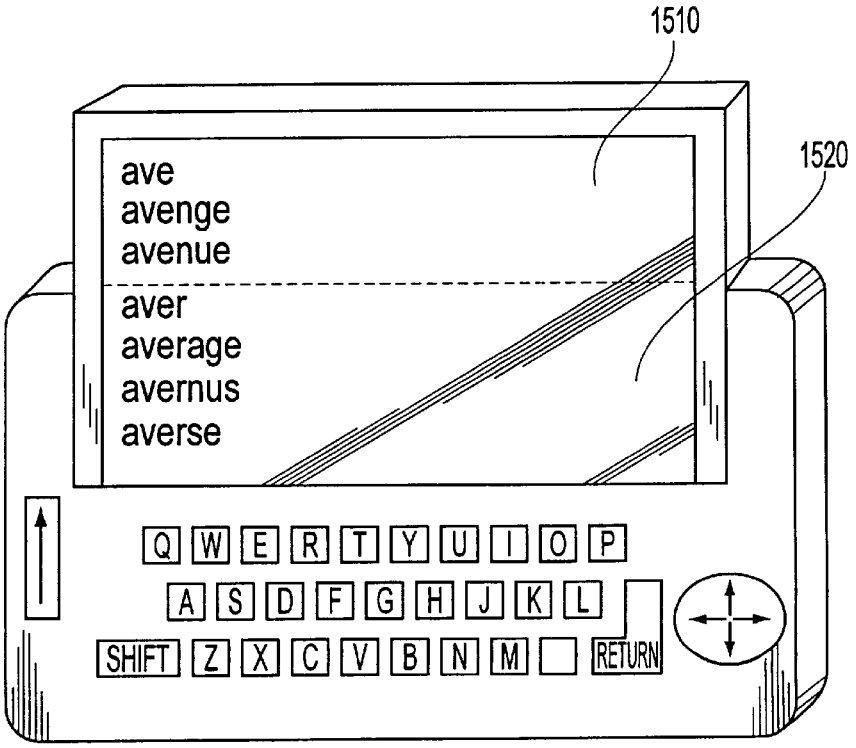

FIGS. 36A and 36B show the use of a portable electronic dictionary.

The electronic dictionary 1500 is normally used in such a form as shown in FIG. 36A. At this time, any desired information can be displayed on screen 1510.

If the screen 1510 is insufficient in display area, a screen 1520 is upward moved to enlarge the display area, as shown in FIG. 36B. In such a state as shown in FIG. 36A, the screen 1520 hides behind the main body and is turned off.

Figure 37A:
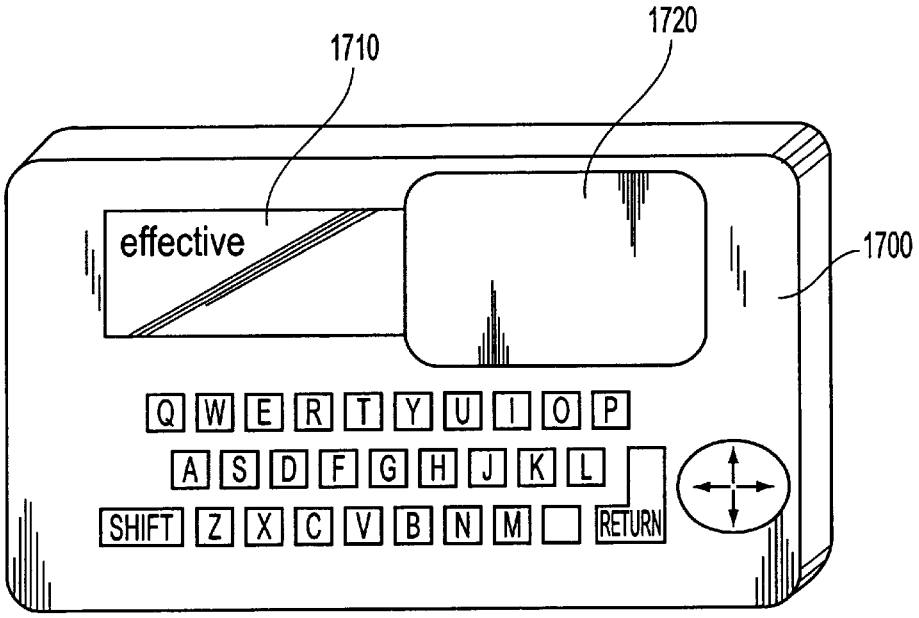
FIGS. 37A and 37B are perspective views of a portable electronic translator which is one of electronic instruments.
Figure 37B:
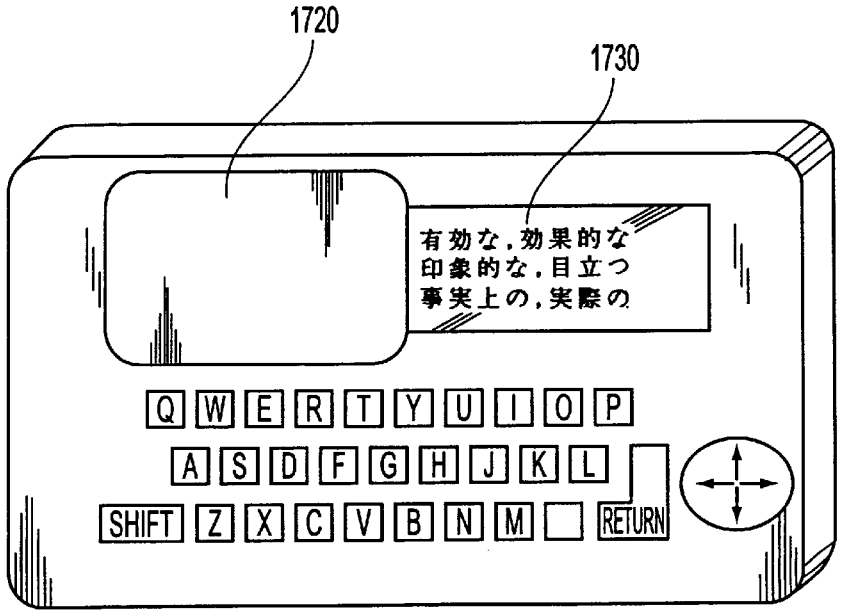

FIGS. 37A and 37B show the use of a portable electronic translator.

The electronic translator 1700 has a screen 1710 on which an English word to be translated is displayed as shown in FIG. 37A. As a cover 1720 is slidably moved as shown in FIG. 37B, Japanese word corresponding to that English word is displayed on a screen 1730. A portion of the screen hiding behind the cover 1720 is turned off. Although FIGS. 37A and 37B show the horizontally movable cover 1720, this cover may slidably be moved in the vertical direction.

Figure 38:
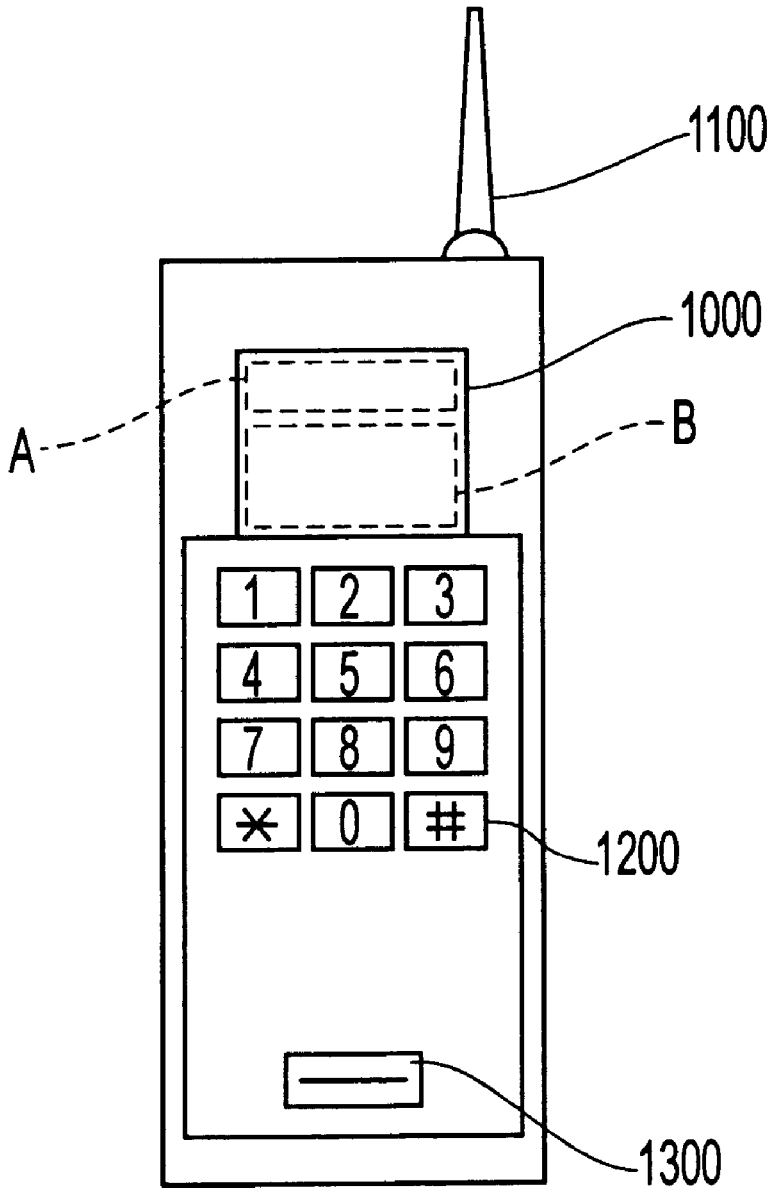
FIG. 38 is the outline of a portable telephone which is one of electronic instruments.

In a portable telephone of FIG. 38, a screen on a display panel is divided into two areas "A" and "B" in the standby mode. The first area "A" displays simple images such as icons or the like while the second area "B" is turned off.

In the electronic instrument mentioned above, any area not used for display is partially turned off. Thus, a desired image can be displayed with very lower power consumption. On the display-off mode, the boosting ratio may be changed depending on the duty ratio, so that any unnecessary power consumption is avoided to reduce the power consumption in the overall electronic instrument.

The present invention is not limited to the aforementioned embodiments, but may be carried out in any of various forms without departing from the spirit and scope of the invention.

For example, a single charge pump circuit may be included in the power supply circuit of the present invention although it is desirable that a plurality of such charge pump circuits are provided in the power supply circuit. The present invention may be applied to deboosting conversion although it is desirable that the present invention is applied to the boosting conversion as described.

It is particularly desirable that the power supply circuit of the present invention is used as a power supply for the display device, but the present invention may similarly be applied to any of various other applications.

It is particularly desirable that the power supply circuit of the present invention is applied to the display device using liquid crystal elements, it may similarly be applied to any of various other devices such as EL (electroluminescent), VFD (vacuum fluorescent display) and others within the scope of the invention.

Although the present invention has been described as to the liquid crystal display device using the MLS drive method, it may be applied to any of various other liquid crystal display devices using various drive methods such as APT method (*IEEE TRANSACTIONS OF ELECTRON DEVICE,* VOL, ED-21, NO. 2, February 1974, P146–155 "SCANNING LIMITATIONS OF LIQUID-CRYSTAL DISPLAYS" P. ALT, P. PLESHKO, ALT & PLESHKO TECHNIC), Smart Addressing (LCD International'95, Liquid-Crystal Display Seminar, C-4, Lecture No. 1, TOT-TORI SANYO DENKI, MATSUSHITA, hosted by NIKKEI BP Company) and others.

What is claimed is:

1. A power supply circuit for converting a voltage and for supplying the converted voltage as a power supply voltage, said power supply circuit comprising:

at least one charge pump circuit which includes a first capacitor, a second capacitor, a first switching means for charging said first capacitor based on a given voltage, and a second switching means for transferring the charge in said first capacitor to said second capacitor; and a switching signal generation circuit for generating a plurality of switching signals which control said first and second switching means;

wherein said first switching means includes a plurality of switching elements, one ends of said switching elements being electrically connected to different potentials, and the other ends thereof being electrically connected to at least one end of said first capacitor; and wherein said switching signal generation circuit receives at least one given first control signal for controlling at least one of a boosting ratio and a boosting ratio, and then generates said switching signals for controlling ON and OFF-states of one of said switching elements specified by said first control signal, and for turning off at least one other switching element.

2. The power supply circuit as defined in claim 1, wherein said switching signal generation circuit comprises:

a circuit for generating a basic switching signal;

a decoder for decoding said first control signal; and an output circuit for receiving the output of said decoder and said basic switching signal to output a switching signal generated based on said basic switching signal toward one of said switching elements to be ON-OFF controlled and to output a switching signal fixed at a given potential toward at least one other switching element not to be ON-OFF controlled.

3. The power supply circuit as defined in claim 2, wherein said output circuit includes a level shifter for converting the amplitude of said basic switching signal on the basis of a reference potential as well as a charge pump potential from said charge pump circuit.

4. The power supply circuit as defined in claim 1, wherein said switching signal generation circuit receives a reference potential and a charge pump potential of said charge pump circuit for setting the potentials of switching signals during the OFF-state period outputted toward switching transistors included in said first and second switching means at one of said reference potential and said charge pump potential both of which are supplied to the source of said switching transistors.

5. A display device comprising:

a power supply circuit as defined in any one of claim 1;

a drive circuit for outputting scan and data signals based on the power supply voltage from said power supply circuit; and a panel having scan lines into which said scan signals are inputted, data lines into which said data signals are inputted, and display elements driven by said scan and data lines;

wherein at least one of the boosting and deboosting ratios is varied by varying said first control signal according to the duty ratio in said panel.

6. The display device as defined in claim 5, wherein a given second signal is used to select K scan lines among N scan lines and to unselect (N-K) scan lines for performing a partial display, and wherein at the partial display, said first control signal is varied depending on the number of selected scan lines to vary at least one of the boosting and deboosting ratios.

7. An electronic instrument comprising:

a display device as defined in claim 5; and a central control means for processing for setting said first and second control signals.

8. An electronic instrument comprising:

a display device as defined in claim 6; and a central control means for processing for setting said first and second control signals.

9. A power supply circuit for converting a voltage and for supplying the converted voltage as a power supply voltage, said power supply circuit comprising:

at least one charge pump circuit which includes a first capacitor, a second capacitor, a first switching means for charging said first capacitor based on a given voltage, and a second switching means for transferring the charge in said first capacitor to said second capacitor; and a switching signal generation circuit for generating a plurality of switching signals which control said first and second switching means;

wherein said switching signal generation circuit receives a reference potential and a charge pump potential of said charge pump circuit for setting the potentials of switching signals during the OFF-state period outputted toward switching transistors included in said first and second switching means at one of said reference potential and said charge pump potential both of which are supplied to the source of said switching transistors.

10. The power supply circuit as defined in claim 9, wherein said switching signal generation circuit sets the potentials of said switching signals during the OFF-state period based on a plurality of charge pump potentials from a plurality of charge pump circuits.

11. The power supply circuit as defined in claim 9, wherein said switching signal generation circuit comprises:

a circuit for generating a basic switching signal; and a level shifter for converting the amplitude of said basic switching signal based on said reference and charge pump potentials.

12. A display device comprising:

a power supply circuit as defined in anyone of claim 9;

a drive circuit for outputting scan and data signals based on the power supply voltage from said power supply circuit; and a panel having scan lines into which said scan signals are inputted, data lines into which said data signals are inputted, and display elements driven by said scan and data lines.

13. An electronic instrument comprising:

a display device as defined in claim 12; and a central control means for processing for controlling said display device.

14. A display device comprising:

a power supply circuit as defined in claim 2;

a drive circuit for outputting scan and data signals based on the power supply voltage from said power supply circuit; and a panel having scan lines into which said scan signals are inputted, data lines into which said data signals are inputted, and display elements driven by said scan and data lines;

wherein at least one of the boosting and deboosting ratios is varied by varying said first control signal according to the duty ratio in said panel.

15. A display device comprising:

a power supply circuit as defined in claim 3;

a drive circuit for outputting scan and data signals based on the power supply voltage from said power supply circuit; and a panel having scan lines into which said scan signals are inputted, data lines into which said data signals are inputted, and display elements driven by said scan and data lines;

wherein at least one of the boosting and deboosting ratios is varied by varying said first control signal according to the duty ratio in said panel.

16. A display device comprising:

a power supply circuit as defined in claim 4;

a drive circuit for outputting scan and data signals based on the power supply voltage from said power supply circuit; and a panel having scan lines into which said scan signals are inputted, data lines into which said data signals are inputted, and display elements driven by said scan and data lines;

wherein at least one of the boosting and deboosting ratios is varied by varying said first control signal according to the duty ratio in said panel.

17. A display device comprising:

a power supply circuit as defined in claim 10;

a drive circuit for outputting scan and data signals based on the power supply voltage from said power supply circuit; and a panel having scan lines into which said scan signals are inputted, data lines into which said data signals are inputted, and display elements driven by said scan and data lines.

18. A display device comprising:

a power supply circuit as defined in claim 11;

a drive circuit for outputting scan and data signals based on the power supply voltage from said power supply circuit; and a panel having scan lines into which said scan signals are inputted, data lines into which said data signals are inputted, and display elements driven by said scan and data lines.

* * * * *